US008037656B2

(12) United States Patent
Liu et al.

(10) Patent No.: US 8,037,656 B2
(45) Date of Patent: Oct. 18, 2011

(54) FLOORING BOARDS WITH PRESS DOWN LOCKING MECHANISM

(76) Inventors: David C. Liu, Marietta, GA (US); Jun Liu, Marietta, GA (US)

( * ) Notice: Subject to any disclaimer, the term of this patent is extended or adjusted under 35 U.S.C. 154(b) by 330 days.

(21) Appl. No.: 12/188,731

(22) Filed: Aug. 8, 2008

(65) Prior Publication Data

US 2010/0031594 A1 Feb. 11, 2010

(51) Int. Cl.
*E04B 2/08* (2006.01)

(52) U.S. Cl. ..... 52/589.1; 52/590.2; 52/591.1; 52/591.4; 52/592.1

(58) Field of Classification Search ..... 52/403.1, 52/582.1, 588.1, 589.1, 590.2, 394, 591.1, 52/591.2, 591.4, 592.1, 592.3, 745.05; 403/339, 403/340, 364

See application file for complete search history.

(56) References Cited

U.S. PATENT DOCUMENTS

| | | | | |
|---|---|---|---|---|
| 6,536,178 | B1 * | 3/2003 | Palsson et al. | 52/589.1 |
| 6,966,161 | B2 | 11/2005 | Palsson | |
| 7,552,568 | B2 * | 6/2009 | Palsson et al. | 52/589.1 |
| 7,603,826 | B1 * | 10/2009 | Moebus | 52/592.1 |
| 2002/0112429 | A1 | 8/2002 | Niese | |
| 2003/0066588 | A1 | 4/2003 | Palsson | |
| 2003/0205017 | A1 | 11/2003 | Palmberg | |
| 2006/0032168 | A1 | 2/2006 | Thiers | |
| 2006/0070332 | A1 | 4/2006 | Palsson | |
| 2007/0094988 | A1 | 5/2007 | Palsson | |

FOREIGN PATENT DOCUMENTS

| | | | |
|---|---|---|---|
| KR | 200309754 | Y1 | 1/2003 |
| KR | 10-0623960 | B1 | 9/2006 |
| KR | 10-0758104 | B1 | 9/2007 |
| WO | WO0047841 | A1 | 8/2000 |
| WO | WO0198604 | A1 | 12/2001 |

OTHER PUBLICATIONS

International Search Report and Written Opinion mailed on Mar. 22, 2010.

Written Opinion of the International Searching Authority, Feb. 17, 2011.

* cited by examiner

*Primary Examiner* — Brian Glessner
*Assistant Examiner* — Patrick Maestri
(74) *Attorney, Agent, or Firm* — Wang Law Firm, Inc.; Li K. Wang

(57) ABSTRACT

A hardwood floor system with press down locking mechanism. Each floor board is equipped with both male and female locking mechanisms. The male locking mechanism of a floor board can be locked into the female locking mechanism of an adjacent floor board by simply exerting downward force on the floor board. The female locking mechanism is equipped with a spring slot that enables easy engagement of male and female locking mechanisms. The invention may be applied not only floor boards, but also to wall tiles and roof tiles.

26 Claims, 25 Drawing Sheets

FLOORING BOARDS WITH PRESS DOWN LOCKING MECHANISM

FIELD OF THE INVENTION

The invention relates to wood flooring, and more particularly, to a press down locking mechanism for flooring boards.

BACKGROUND OF THE INVENTION

Traditional floor boards are installed via nail down or glue down methods. Recently, floor boards can be installed via floating method with mechanical locks. Most of these mechanical locks are based on a mechanism of flipping down on one edge to lock and sliding into another edge to secure the entire board. The locks require precision milling for the locks to work properly and small deformation of flooring panel after milling will render the locks unusable.

Therefore, there is a need for an apparatus that simplifies flooring board installation process and reduces relative movement between two adjacent flooring boards, and there is also a need for the locks to accept floor boards, such as solid hardwood board, that are not as dimensionally stable as high-density floor (HDF) boards or floor boards with some degree of milling tolerance. It is to this apparatus the present invention is primarily directed to.

SUMMARY OF THE INVENTION

The present invention provides a floor board with an improved press down locking mechanism. The floor board includes a top side, a bottom side, a front end, a back end, a left end with a male locking device, and a right end with a female locking device and a spring slot defining the female locking device. The male locking device includes an upwardly recessed region, an upwardly protruding region adjacent to the recessed region, and a locking edge defining one side of the protruding region. The female locking device includes a downwardly protruding region, a downwardly recessed region adjacent to the downwardly protruding region, and a locking corner defining one side of the downwardly recessed region.

In another embodiment of the invention there is provided a floor system. The floor system includes a first floor board with a male locking device, a second floor board with a female locking device, and a spring slot defining the female locking device. The female locking device of the second board engages to the male locking device of the first board by pressing down the female locking device of the second board against the male locking device of the first board.

In yet another embodiment of the invention there is provided a floor board. The floor board has a body comprising a top side, a bottom side, a front end, a back end, a left end, the left end having a male locking device, and a right end, the right end having a female locking device. The male locking device comprises a downwardly recessed region, and a male interface element adjacent to the upwardly recessed region. The female locking device comprises a downwardly protruding region, and an upwardly recessed region adjacent to the downwardly protruding region, and a female interface element adjacent to the upwardly recessed region.

In yet another embodiment, there is provided a floor tile. The floor tile comprises a body and a first locking device. The body has a length, a first lateral side along the length and a second lateral side along the length and opposing the first lateral side. The first locking device is attached to the first lateral side, and the first locking device being made from a material different from the body.

In yet another embodiment, there is provided a floor system. The floor system comprises a first floor board with a male locking device and a second floor board with a female locking device. The male locking device of the first floor board is engaged to the female locking device through application of a vertical force on the second floor board, and the male locking device engages the female locking device on no more than three contact surfaces.

In yet another embodiment, there is provided a locking clip for joining two adjacent floor boards. The locking clip comprises two male locking devices joined together and sharing a common downwardly recessed region, wherein each male locking device being capable of engaging to an adjacent floor board.

In yet another embodiment, there is provided a floor tile. The floor tile comprises a body, a substrate, and a first locking device. The substrate has a length, a first lateral side along the length and a second lateral side along the length and opposing the first lateral side, and the substrate is attached to the body. The first locking device is attached to the first lateral side, and the body and substrate is made from different materials.

In yet another embodiment, there is provided a floor system. The floor system comprises a first floor board with a female locking device and a second floor board with a male locking device. The first floor board and the second floor board are engaged by a predetermined pairs of locking surfaces.

In yet another embodiment, there is provided a system for installing floor tiles on a floor. The system comprises an underlayer, a plurality of locking clips distributed on the underlayer, and a plurality of floor tiles placed on the top of the underlayer and secured by the plurality of locking clips.

In yet another embodiment, there is provided a method for installing floor tiles on a floor. The method comprises the steps of attaching an underlayer on the floor, placing the floor tiles on the underlayer, and securing the floor tiles through a plurality of locking clips.

In yet another embodiment, there is provided a floor board that has a top side, a bottom side, a front end, a back end, a left end with a male locking device, and a right end with a female locking device. The male locking device comprises a downwardly recessed region, an upwardly protruding region adjacent to the recessed region, a locking corner defining one side of the protruding region, and a spring slot under the upwardly protruding region. The female locking device comprises a downwardly protruding region, an upwardly recessed region adjacent to the downwardly protruding region, and a locking edge defining one side of the downwardly recessed region.

In yet another embodiment, there is provided a floor system. The floor system has a first floor board and a second floor board. The first floor board has a male locking device with a spring slot and the second floor board has a female locking device. The female locking device of the second board is engaged to the male locking device of the first board by pressing down the female locking device of the second board against the male locking device of the first board.

BRIEF DESCRIPTION OF THE DRAWINGS

Features and advantages of embodiments of the invention will become apparent as the following Detailed Description proceeds, and upon reference to the Drawings, where like numerals depict like elements, and in which.

DETAILED DESCRIPTION OF THE INVENTION

Figure 1A:
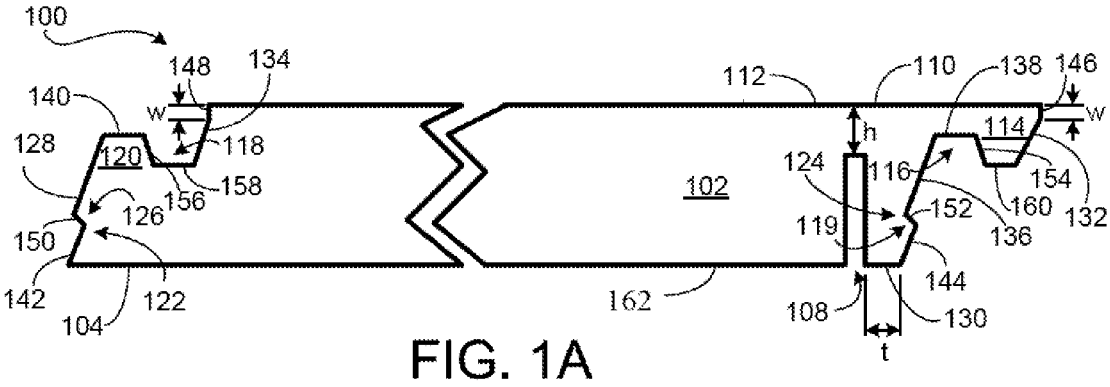
FIG. 1A illustrates a floor board with a locking device according to one embodiment of the invention.

The present invention provides a press down locking system for floor boards. FIG. 1A depicts profile 100 of a floor board with a body 102, a top side 112, a bottom side 162, a left end 104, and a right end 110. The body 102 is generally made from solid wood or wooden materials, such as MDF, HDF, OSB, multilayer wood, and bamboo, and may include a top decorative layer (not shown). Alternatively, the body 102 may also be made from man-made materials, such as plastic, fiber glass, plastic-wood composite, metal, etc. The top decorative layer is generally made from wood to give an elegant appearance. The left end 104 has a male locking device that includes a downwardly recessed region 118, an upwardly protruding region 120 adjacent to the recessed region 118, a locking surface 126, and a locking corner 122. The right end 110 has a female locking device that includes a downwardly protruding region 114, an upwardly recessed region 116 adjacent to the protruding region 114, a locking surface 124, and a locking edge 119. Optionally, the right end 110 has also a spring slot 108 that defines a locking column 130 and the female locking device. The body 102 has a longitudinal length and a width. The male locking device and the female locking device are generally placed on the left end 104 and right end 110, respectively, along the entire length of the body 102.

Figure 1B:
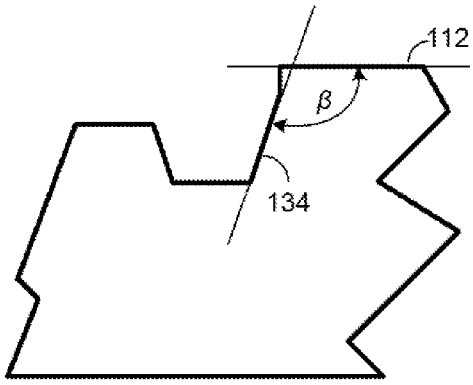
FIG. 1B illustrates an angle between two surfaces of a male locking device.
Figure 1C:
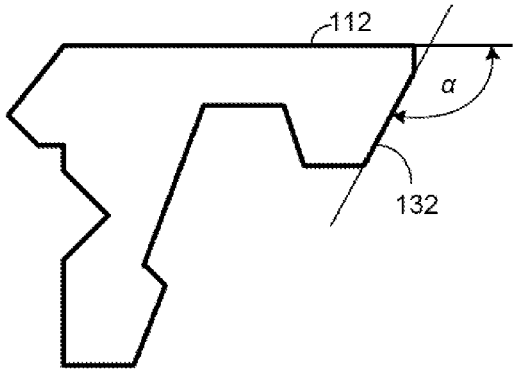
FIG. 1C illustrates an angle between two surfaces of a female locking device.

The downwardly protruding region 114 of the female locking device is defined by three surfaces 132, 154, 160. The surface 132 forms an angle $\alpha$ with the top side 112 as shown in FIG. 1C; however, the sharp edge should be replaced by a vertical surface 146. The sharp edge poses risk to users when a floor board dislodges from an adjacent floor board. The sharp edge also makes the floor board prone to damage. The vertical surface 146 preferably has a width w between 1 mm and 2 mm. It may also be as thick as 3-5 mm if needed for re-sanding purpose.

Figure 3:
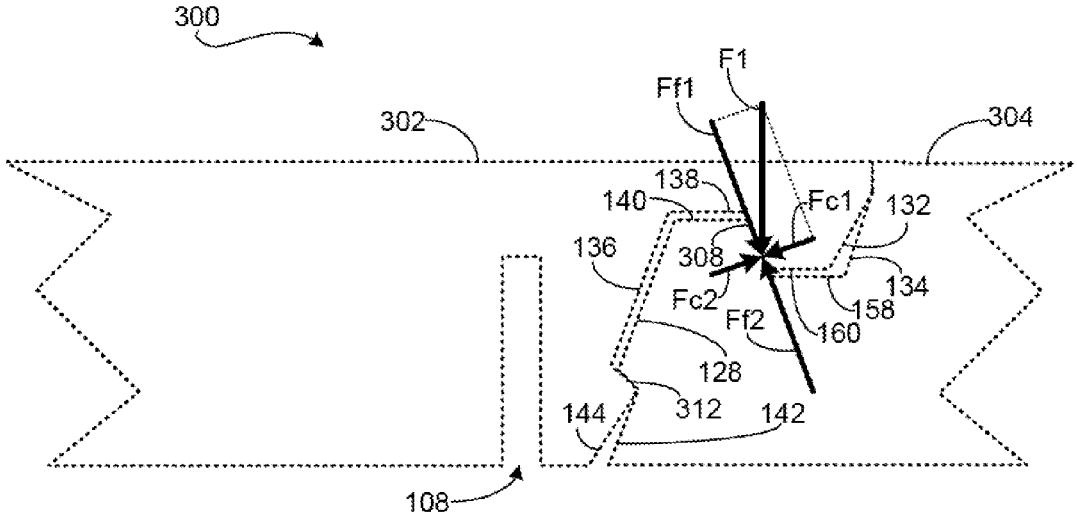
FIG. 3 illustrates a force decomposition during engagement of two floor boards.
Figure 15:
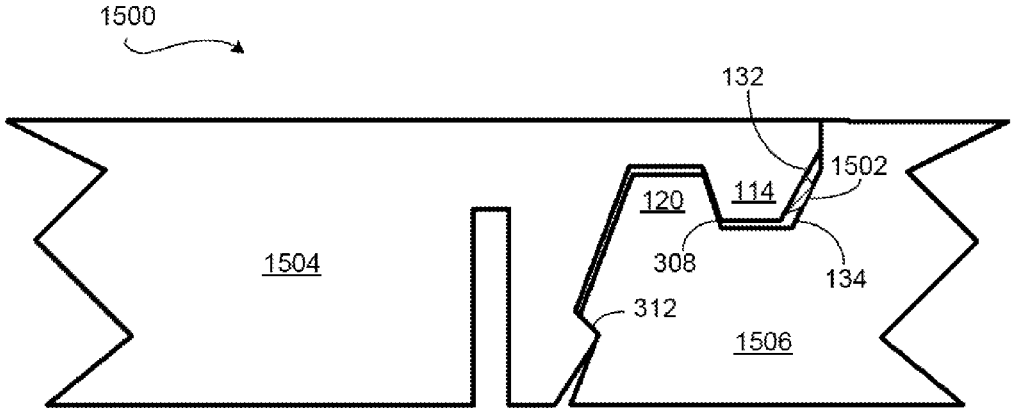
FIG. 15 illustrates another aspect of the self-healing feature of the floor board according to the invention.

The downwardly recessed region 118 of the male locking device is defined by three surfaces 134,156, 158. The surface 134 forms an angle $\beta$ with the top side 112 as shown in FIG. 1B. The angle $\alpha$ should be different from angle $\beta$, so the surfaces 132 and 134 are separated by a space as shown in FIG. 3. The vertical surface 146 is matched to the vertical surface 148 at the male locking device. The space between the surfaces 132 and 134 may also be created by making the vertical surface 148 a little bit higher than the surface 146 as shown in FIG. 15, or slight hollowing the surface 1502 (not shown). The surfaces 146 and 148 may be coated with rubber, wax, TEFLON, or other suitable materials to further prevent the water damage to the lock. A thin layer of rubber, foam, or cork may also be applied to the surfaces 132 and 134 to further protect these surfaces and prevent penetration of water into the lock. This protection could achieve water sealing of the gaps between floor boards, which would prevent damage and slow down aging of floor boards.

Figure 12:
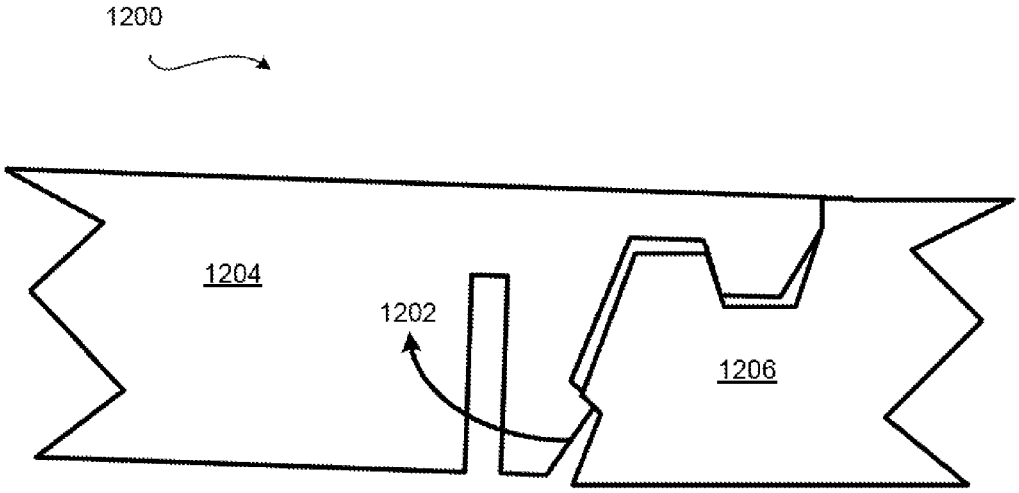
FIG. 12 depicts a method for unlocking two joined floor boards.

The locking corner 122 is defined by the locking surface 126 and surface 142. The locking edge 119 is defined by the locking surface 124 and surface 144. The surfaces 142 and 144 are sloped slightly different as to allow a gap between then as shown in FIG. 3. The locking surfaces 124, 126 are generally downwardly sloped as to allow easy disengagement of two engaged boards by applying a lifting force 1202 as shown in FIG. 12.

When the spring slot 108 is provided, the spring slot 108 provides a spring effect to the locking column 130. When milling the spring slot 108, the spring slot 108 should not be "cut" too deep into the floor board and the height "h" should not be too thin. The spring slot 108 may have different shapes; the spring slot 108 may be titled instead of straight. For example, for a board of 16 mm thickness, the height "h" may be 4 mm. The dimensions may be changed according to the material of the floor board or the desired flexibility. The thickness "t" of the locking column 130 should not be too thin either as to weaken the locking column 130. The thickness should also ensure the locking column is strong enough to survive and remain strong after installation. An example of the thickness "t" is 1.5 mm. The thickness "t" affects the flexibility of the locking column 130.

Figure 2:
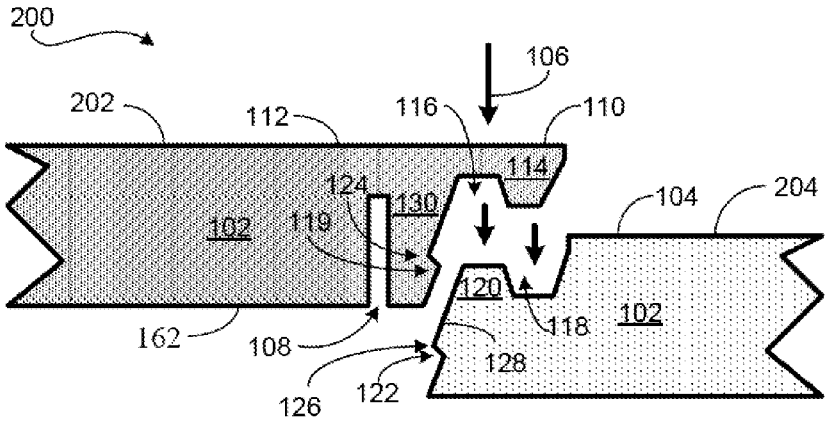
FIG. 2 illustrates engagement of a locking device according to one embodiment of the invention.
Figure 22:
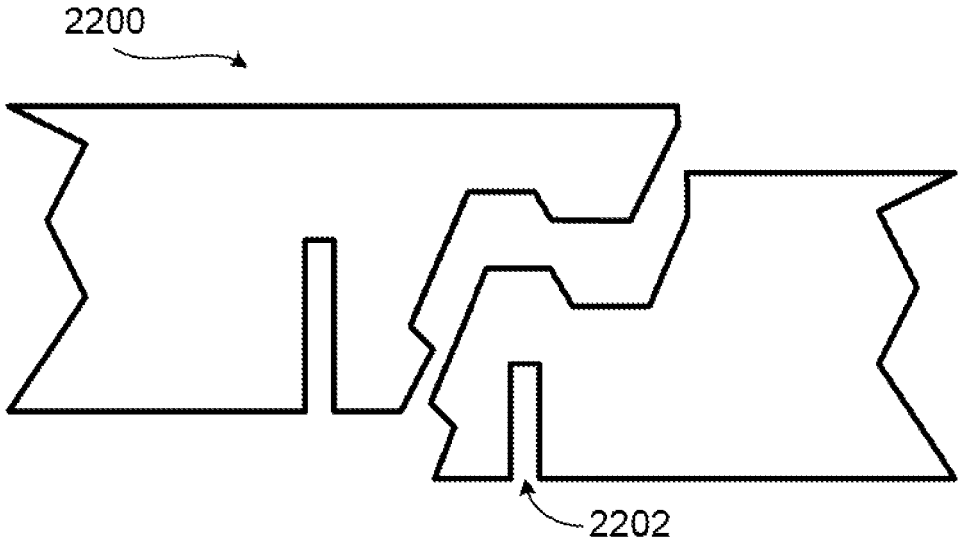
FIG. 22 illustrates a spring slot in the male locking device.

The floor board according to the invention allows easy assembly of hardwood floor. During the installation of hardwood floor, a portion of a floor board is generally slid into a receiving portion of an adjacent floor board. The floor board according to the invention enables easy floor installation by allowing vertical engagement of adjacent floor boards as shown in FIG. 2. In FIG. 2, it is shown two adjacent floor boards, 202, 204. Floor board 204 is shown as installed, and floor board 202 is being installed adjacent to floor board 204. The two floor boards 202, 204 can be vertically engaged by placing the female locking device on top of the male locking device and applying a vertical force 106 onto the top side of the floor board 202. As the force 106 is applied, the protruding region 114 engages the downwardly recessed region 118 and upwardly protruding region 120 engages the upwardly recessed region 116. The locking edge 119 slides down the left face 128 of the upwardly protruding region 120, forcing against the left face 128 and pushing the locking column 130 away from the left face 128. As the locking edge 119 slides past the end of the left face 128, the locking column 130 snaps back toward the locking corner 122 and two locking surfaces 124, 126 are joined together. When the locking edge 119 is being pushed away from the left face 128 of the upwardly protruding region 120, the spring slot 108 is compressed and thus enabling a small movement of the locking column 130. The spring slot 108 allows an easy fitting between a male locking device and a female locking device and yet still provides a compression force to secure the two locking devices in place. Because of the flexibility provided by the spring slot 108, each floor board no longer has to be milled to a very high precision. The floor board will also accept small deformation of wood caused by moisture change or wood internal stress release. The spring slot 108 allows floor boards to tolerate small imperfection between two adjacent floor boards and yet enabling them to be securely engaged. A slot 2202 as shown in FIG. 22 may also be provided under the upwardly protruding region 120 and this slot can also achieve this similar effect as the spring slot 108. The combination of two spring slots enable more flexible locking also allow the spring slots to be shorter. The combination of two spring slots allows thin floor boards to use this locking mechanism.

Figure 4:
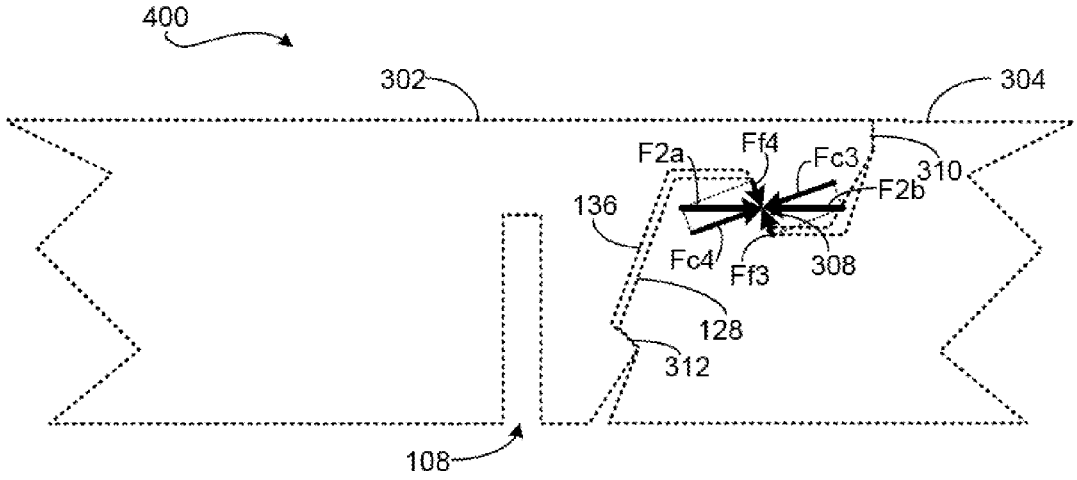
FIG. 4 illustrates another force decomposition after engagement of two floor boards.

FIG. 3 is an illustration of a press down force F1 just before the full engagement of a male locking device and a female locking device. The down force F1 is exerted on floor board 302 and can be broken down into a downward friction force Ff1 and a compression force Fc1. These two component forces Ff1 and Fc1 are counter balanced by reactive forces Ff2 and Fc2. After the male locking device and the female locking device are engaged, the down force F1 is no longer needed and a lateral force is exerted by both locking devices as shown in FIG. 4. The lateral force F2*a* can be broken down to friction force Ff4 and compression force Fc4. These two component forces Ff4 and Fc4 are counter balanced by reactive forces Ff3 and Fc3. The lateral forces are present on surface 308, 310, and 312 and each of these lateral forces can be broken down as shown in FIG. 4.

FIG. 3 is an illustration of a press down force F1 just before the full engagement of a male locking device and a female locking device. The down force F1 is exerted on floor board 302 and can be broken down into a downward friction force Ff1 and a compression force Fc1. These two component forces Ff1 and Fc1 are counter balanced by reactive forces Ff2 and Fc2. After the male locking device and the female locking device are engaged, the down force F1 is no longer needed and a lateral force is exerted by both locking devices as shown in FIG. 4. The lateral force F2*a* can be broken down to friction force Ff4 and compression force Fc4. These two component forces Ff3 and Fc3 are counter balanced by reactive forces Ff3 and Fc3. The lateral forces are present on surface 308, 310, and 312 and each of these lateral forces can be broken down as shown in FIG. 4.

The two adjacent floor boards of the present invention can be tightly engaged through multiple forces acting on three surfaces 308, 310, and 312. These three separate and independent surfaces are the main contact points between two adjacent floor boards. The upwardly protruding region 120 of one floor board is tightly secured by the downwardly protruding region 114 and the locking surface 124, and the downwardly protruding region 114 is tightly secured by the upwardly protruding region 120 and the vertical surface 148. As it is shown in FIGS. 3 and 4, preferably there is a space between surfaces 138 and 140 and also a space between surfaces 128 and 136. There is also a space between the surfaces 142 and 144 as stated above. The upwardly protruding region 120 and downwardly protruding region 114 are stressed. The upwardly protruding region 120 shifts to the left, and downwardly protruding region 114 shifts to the right. The space between surfaces 128 and 136 allows the upwardly protruding region 120 to shift left, and the space between surfaces 132 and 134 allow the downwardly protruding region 114 to shift right. This shift or deformation maintains a stress force to squeeze the contact between the vertical surfaces 146 and 148, and between the surfaces 150 and 152. This strong squeezing force will ensure there is no gap between the surfaces 146 and 148, and it will also ensure the lock between the two adjacent floor boards is tight. The squeeze force could help to eliminate the gaps between boards as floor boards shrinking in low moisture environment after installation. The lock will not easily be unlocked even when wood deformation occurs after the installation. Additionally, this strong squeeze on the contact surface will diminish any relative movement between the floor boards, thus reducing sound created from the lock. The squeeze force also helps to achieve water seal at lock between two floor boards.

Figure 5:
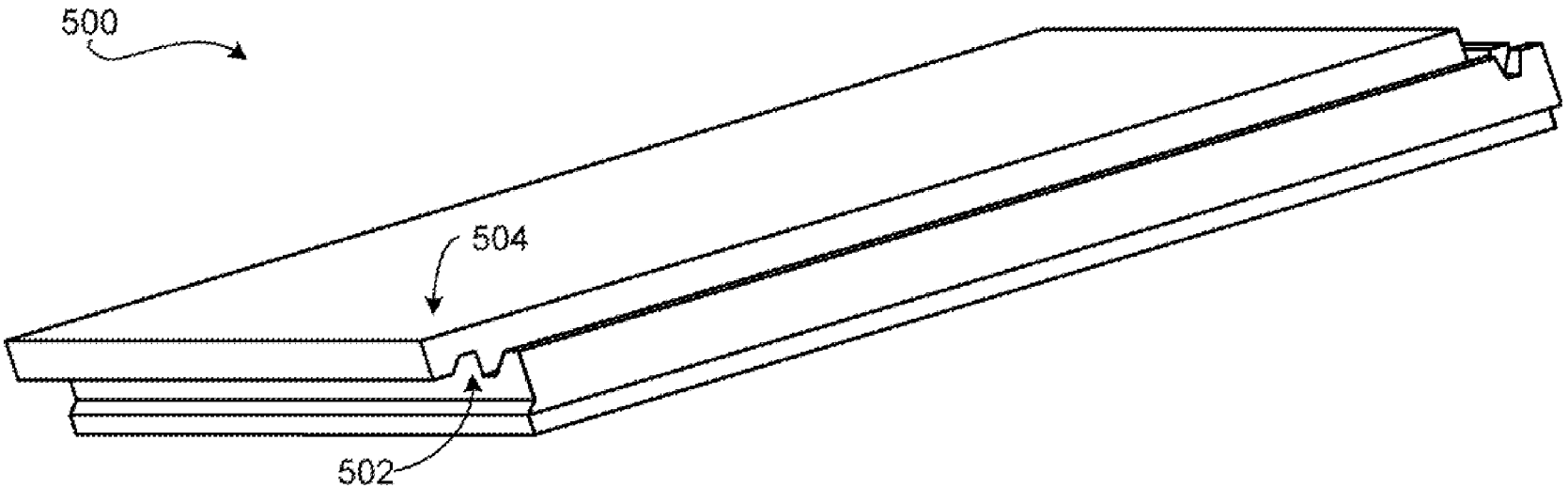
FIG. 5 illustrates a perspective view of a floor board according to one embodiment of the invention.
Figure 6:
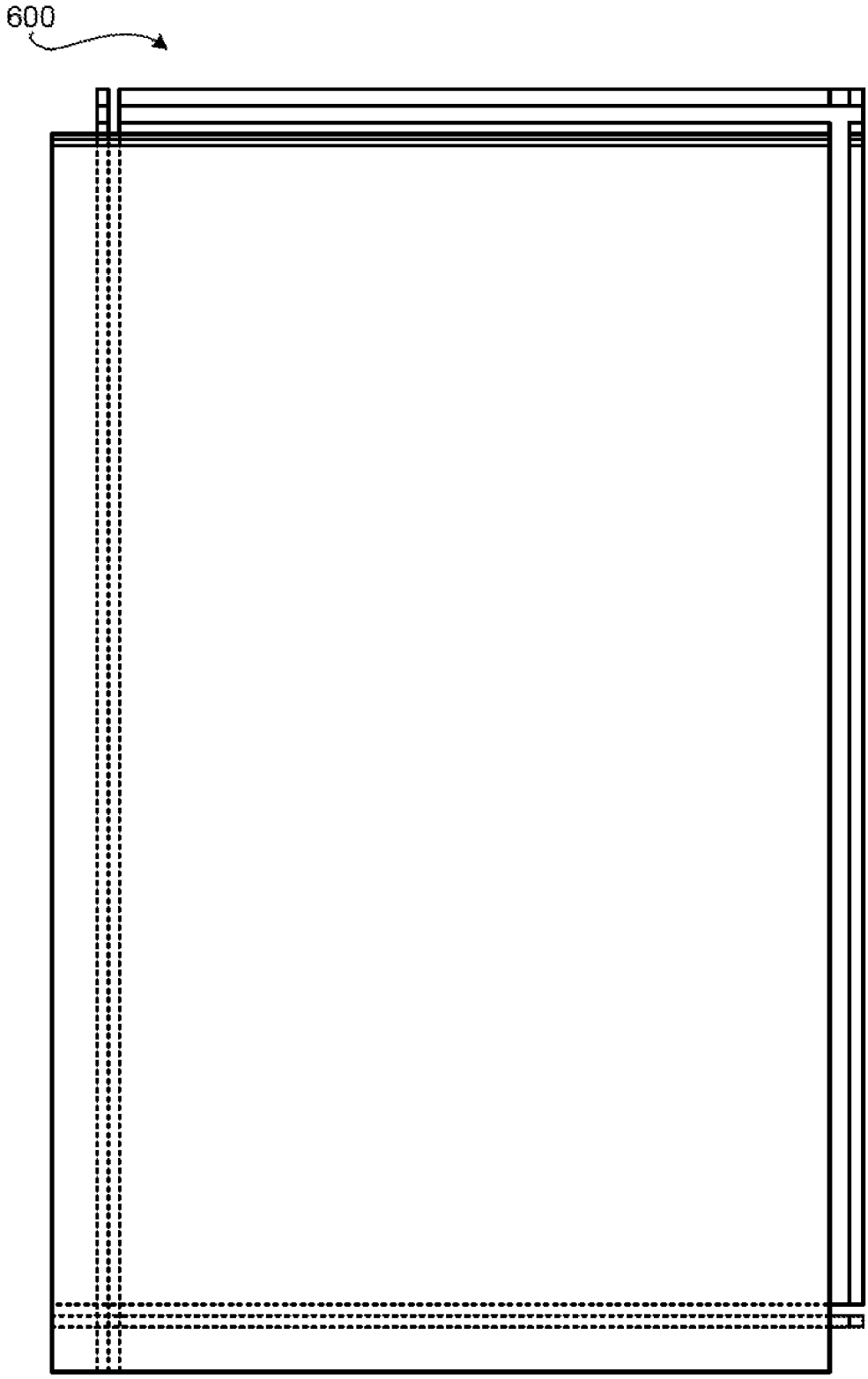
FIG. 6 illustrates a top view of a floor board according to one embodiment of the invention.

FIG. 5 illustrates a perspective view of a floor board. The floor board has four sides and includes a male locking device 502 along two sides and a female locking device 504 along the remaining two sides. Though it is shown the male locking device 502 is on two adjacent sides of the floor boar, the male locking device 502 may also be located in opposing two sides. Similarly, the location of the female locking device 504 may also be alternated. FIG. 6 is a top view of a floor board.

Figure 7:
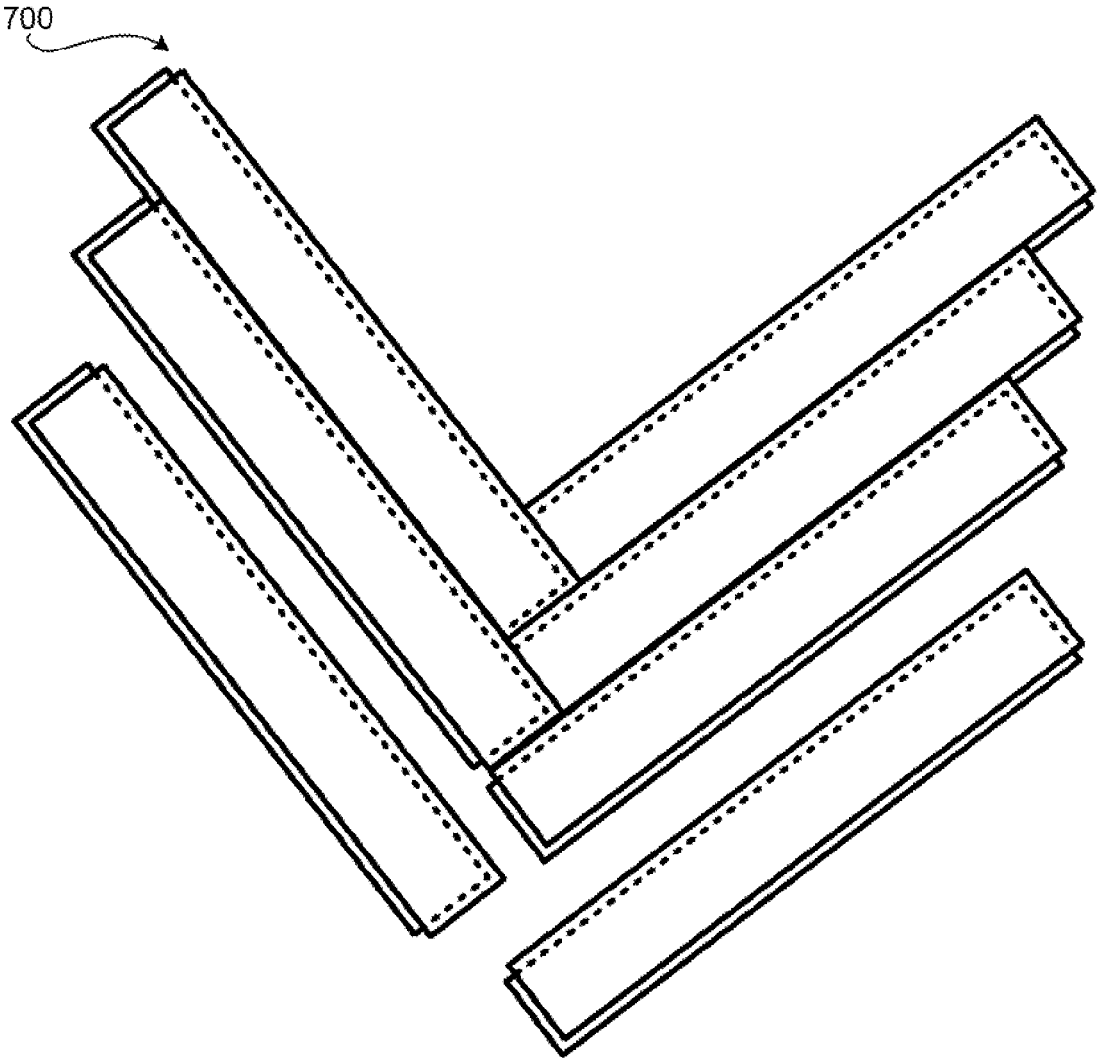
FIG. 7 depicts assembly of a hardwood floor employing floor boards of the invention.
Figure 8:
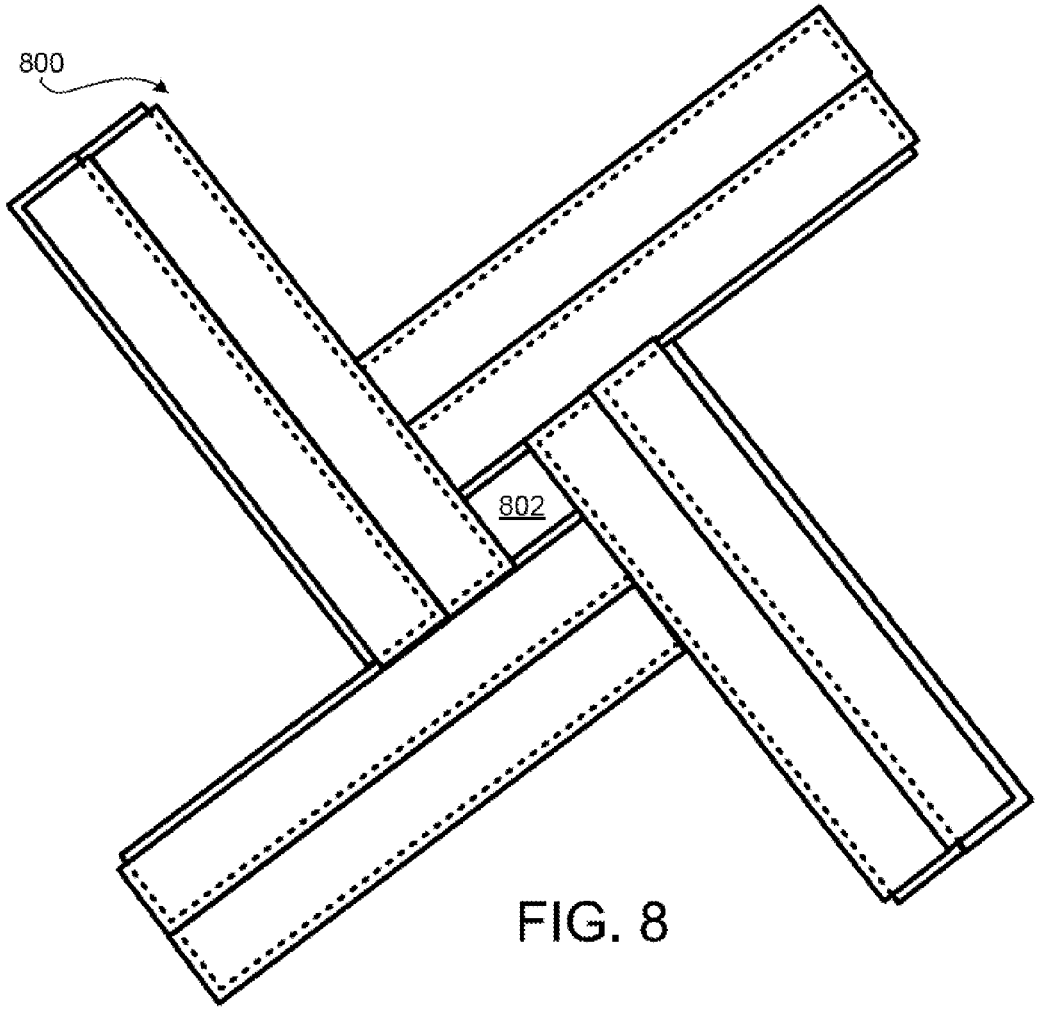
FIG. 8 depicts an alternative assembly of a hardwood floor.
Figure 9:
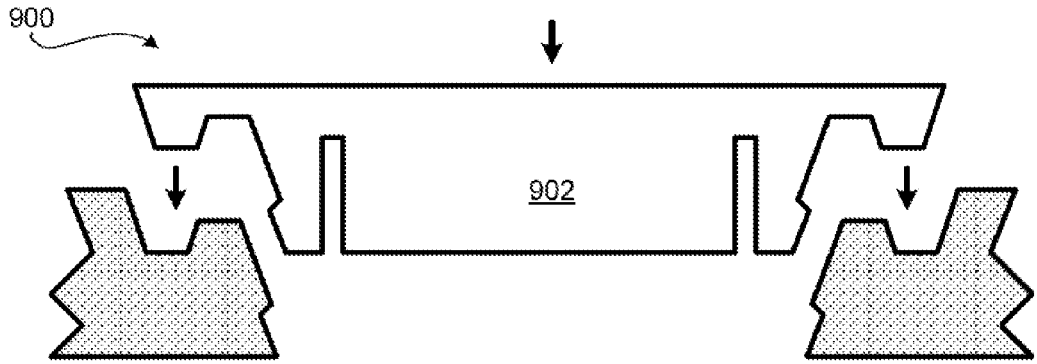
FIG. 9 depicts engagement of a locking device according to one alternative embodiment of the present invention.

FIG. 7 illustrates an assembly of a Herringbone type hardwood floor using floor boards of the present invention. The floor boards can be easily assembled adjacently by pressing a female locking device of a floor board downwardly against the male locking device of another floor board. FIG. 8 illustrates an alternative assembly of hardwood floor. In the pattern shown by FIG. 8, a center hole 802 is left open. This center hole 802 is presented with two male locking mechanisms placed on the opposite side of the center hole 802 and cannot be filled using engaging mechanisms that slide portion of one floor board into another floor board. A floor board equipped with two female locking mechanisms placed on the opposite side of the floor board is ideal for filling the center hole 802. FIG. 9 illustrates profile of a floor board 902 with two female locking devices. Though not illustrated, ordinary skill in the art would appreciate that floor boards with an identical locking device placed on all four sides can be easily construed from the teachings of this invention.

Figure 10:
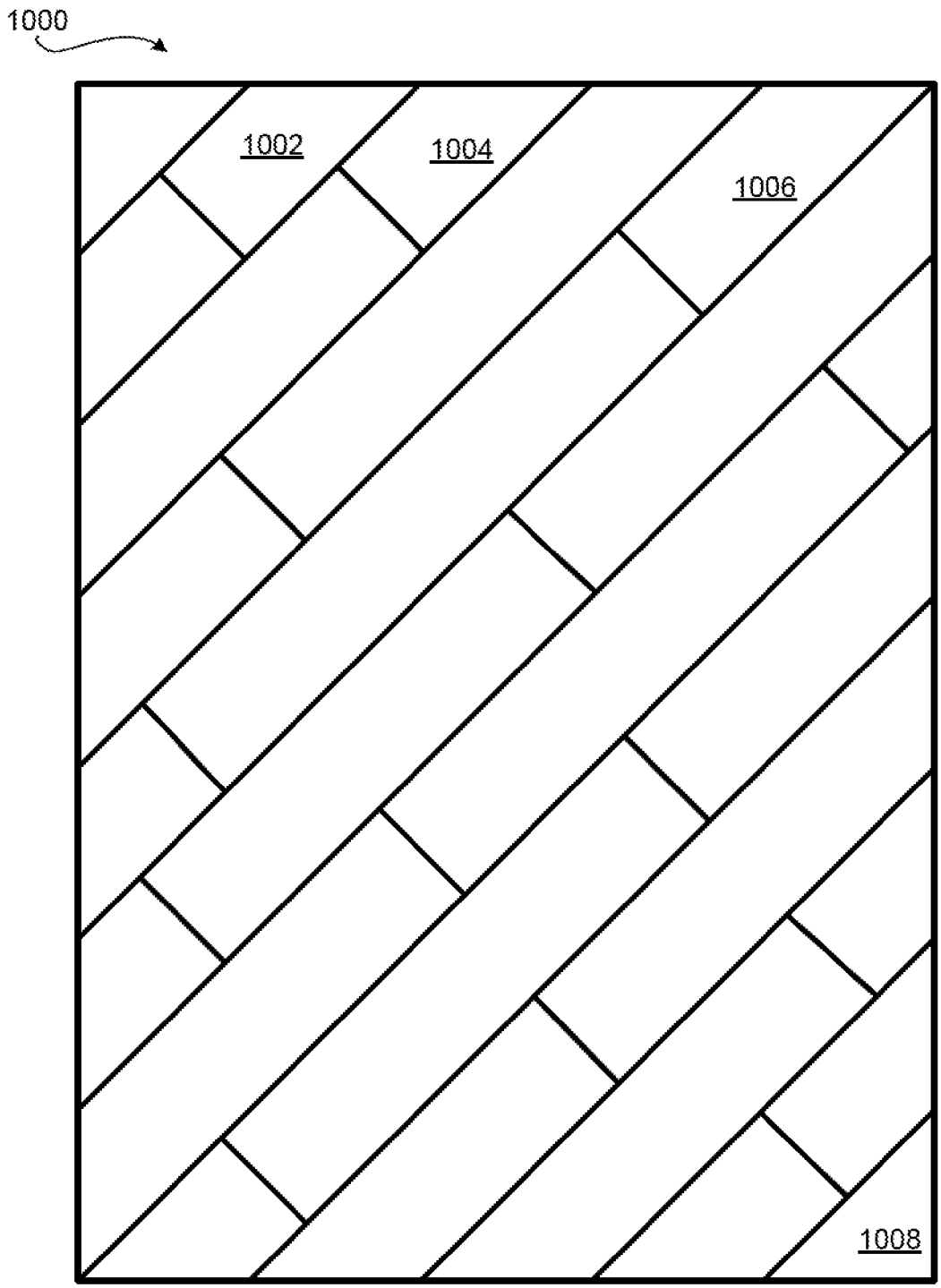
FIG. 10 depicts layout of an assembled hardwood floor.

The floor board according to the invention allows easy assembly of hardwood floor, especially around corners and boarders. FIG. 10 depicts an assembled hardwood floor 1000 with a particular layout of floor boards. Assuming the assembly of the hardwood floor 1000 started from the top left corner, the floor boards, for example, 1002, 1004, and 1006, placed near the wall can be easily assembled since the floor boards according to the invention do not require extra space to "slide" them into the assembled floor boards. The floor boards can be simply assembled into the position by pressing down. The press down feature is especially useful when assembling a corner floor board such as floor board 1008. This press down feature will save most of installation time because the edges and corners are most time consuming area in the installation of floating floors.

Figure 11:
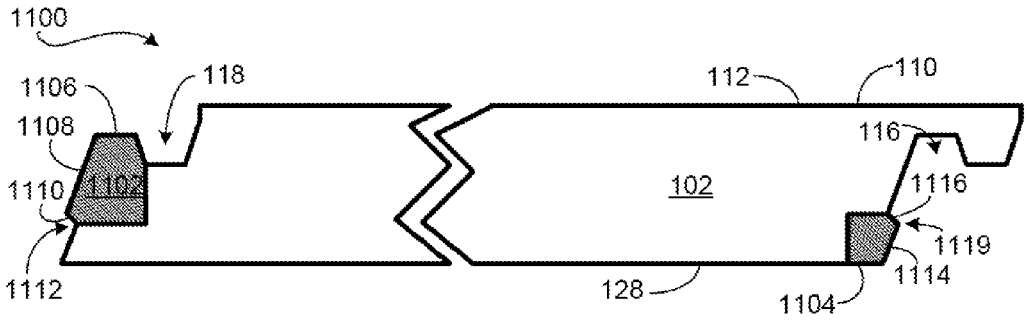
FIG. 11 depicts profile of an alternative embodiment of a floor board according to the invention.

FIG. 11 illustrates profile of an alternative embodiment of a floor board. In the embodiment shown in FIG. 11, the male locking device has a male interface element 1102 and the female locking device has a female interface element 1104. The male interface element 1102 includes an upwardly protruding region 1106 adjacent to the downwardly recessed region 118, an outwardly slanted surface 1108, and inwardly slanted surface 1110. The inwardly slanted surface 1110 and the body 102 of the floor board forms a locking corner 1112. The female interface element 1104 is located in the lower part of the body 102 of the floor board. The female interface element 1104 includes an outwardly slanted surface 114 and an inwardly slated surface 1116. The inwardly slanted surface 1116 and the outwardly slanted surface 1114 forms a locking edge 1119. The male interface element 1102 and the female interface element 1104 can be made from plastic, rubber, metal, or different type of wood, and then attached to the floor board. They can be attached first to the wood and then milled with wood; this way the precision will be achieve. The use of the flexible material improves engagement of two adjacent floor boards and may reduce friction and noise resulting from any relative movement between the floor boards. The noise can be further reduced by coating the male locking device and female locking device with a thin film. Because of flexibility provided by the female interface element 1104, the spring slot may not be needed.

Figure 13:
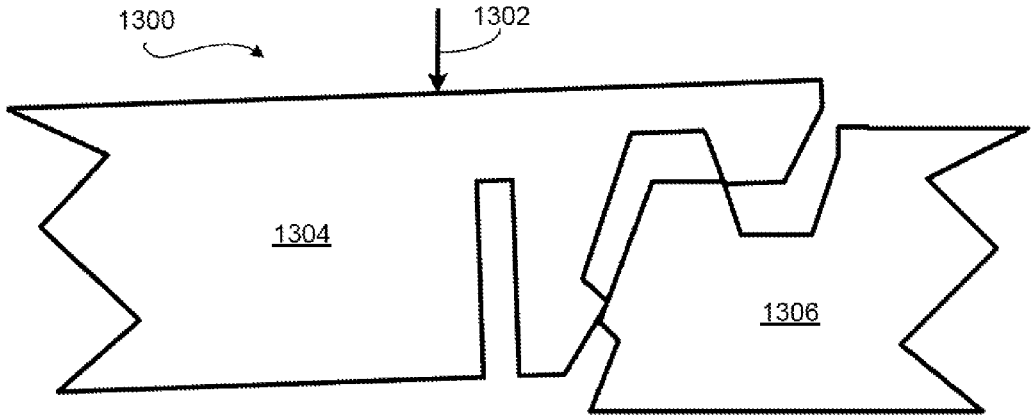
FIG. 13 depicts a self-healing feature of the floor board according to the invention.

FIG. 12 illustrates a method for separating two joined floor boards. Two floor boards 1204, 1206 are joined by the male and female locking devices. To separate one floor board from another floor board, a small lifting force 1202 can be applied to floor board 1204. By simply lifting the floor board 1204, the floor board 1204 can be separated from floor board 1206. Alternatively, it can be also placed a key, such as a sharp metal, between surfaces 144 and 142, press the floor down, and the lock will disengaged by the key. This key may need to unlock two edges (XY) squares when the board is large. This unlocking mechanism allows installer to repair, rework an installed floor boards without much effort. This fast and easy unlocking mechanism also makes this floating floor portable and easily installed and dismounted in short time, which is very useful for temporary floor, such as used in stadium, platform, show booth, tent and etc. It allows easy repair and replacement of worn out floor boards in high traffic area or floor boards damaged by water. FIG. 13 illustrates a self-healing feature of the floor board according to the invention. When two adjacent floor boards 1304, 1306 become disengaged from each other for some reason, a simple vertical downward force 1302 applied to floor board 1304 will snap the two floor boards back together. This downward force 1302 can be from simple stepping down by a user. This self-healing feature is extremely useful since there is no need to remove floor boards before reassembling them together and there is no need to hire professional floor installer to fix disengaged floor boards. Simple walking movement on the surface of the floor boards will continuously reinforce the lock between the adjacent floor boards.

The self-healing feature is also useful, if some dirt or alien substance 1502 got into the space between the surfaces 132 and 134 as shown in FIG. 15. The presence of this dirt or substance 1502 will compress against the downwardly protruding region 114, which in turn will compress against the upwardly protruding region 120. Since the two floor boards 1504, 1506 are tightly coupled through engagement of surfaces 308, 312, the extra compression from the upwardly protruding region 120 on to the surface 308 will tighten the two adjacent floor boards 1504, 1506. This self-healing feature also enables floor boards continued to be locked if there is some small deformation of the boards. The self healing feature will heal disengage locks and will not allow water and dirty getting into the lock. This self-healing feature will extend the life of locks and floors.

Figure 14:
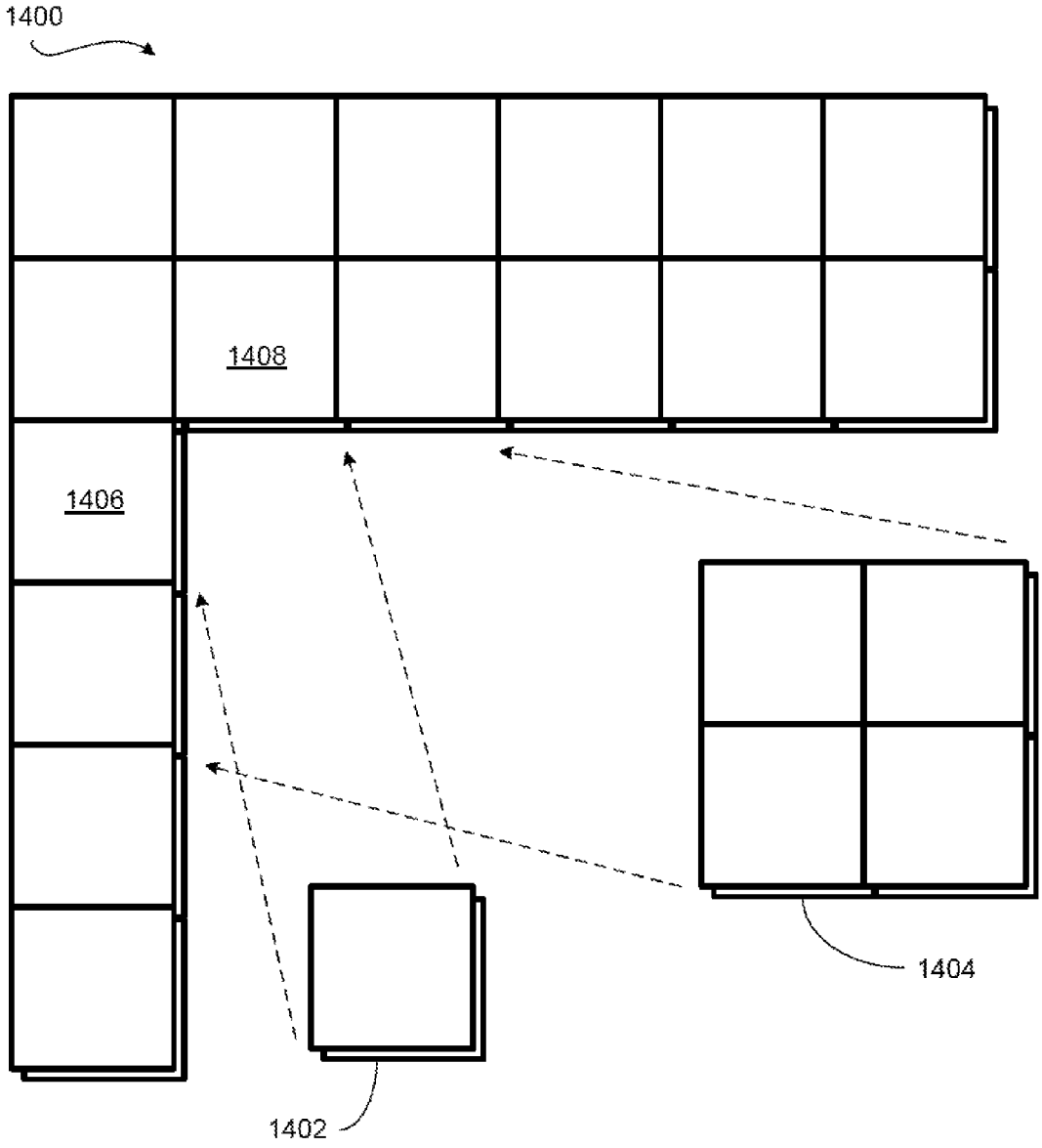
FIG. 14 illustrates easy assembling of a hardwood floor using square floor boards according to the invention.

FIG. 14 illustrates assembly of square floor boards according to the invention. A very desirable feature of the floor board of the present invention is that a floor board can simultaneously engage two other floor boards in two different directions. For example, floor board 1402 can engage floor boards 1406, 1408 simultaneously, one in X direction and one in Y direction. Several square floor boards can be assembled into a bigger "square," before being placed in its final place as shown in FIG. 14.

This assembling enables rapid floor installation. It can installed not only square or rectangular shape of floor boards, it can also install any shape of floor such as polygon, decorative shapes, circular, oval, etc. This feature all the end user to make their own color and design for the floor with available prefabricated shapes and colors/styles from factory without burden of extra cost for installation and fabrications.

Figure 16:
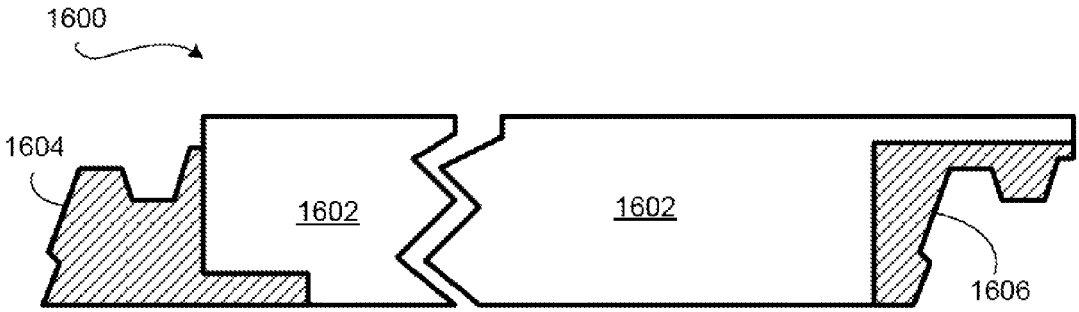
FIG. 16 depicts an alternative embodiment in which the locking mechanism is made from a material different from the floor board.
Figure 17:
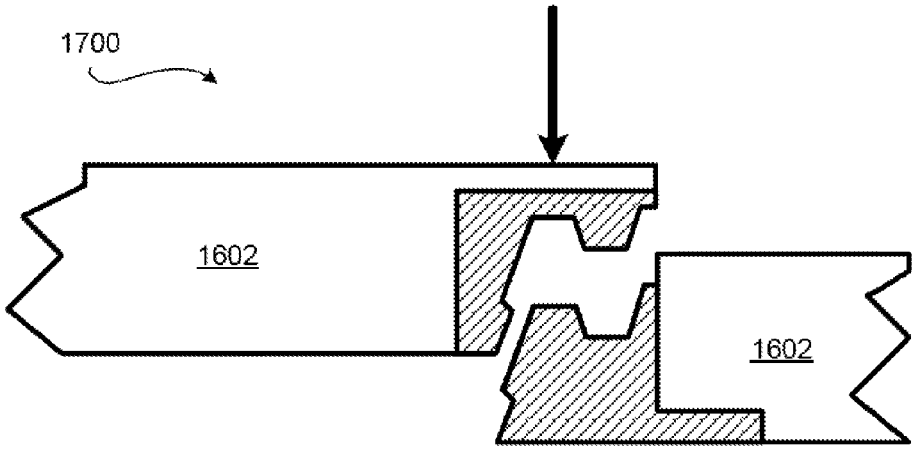
FIG. 17 depicts the engagement of two floor boards of FIG. 16.

The present invention is suitable not only for floor boards made from wood and other materials described above, but also applicable for ceramic, stone, or porcelain floor tiles, or other kinds of board such as roof tiles, ceiling tiles, wall tiles or panels. FIG. 16 is an illustration of a profile 1600 of a ceramic floor tile according to the invention. The ceramic/porcelain floor tile has a body 1602 with a male locking device 1604 and a female locking device 1606 attached to its edges. The male locking device 1604 and female locking device 1606 preferably are made from rubber, plastic, foam, plastic wood composite, or metal sheet and glued to the ceramic/porcelain floor tile. The male locking device 1604 extends along the length of the ceramic floor tile and is glued to the ceramic floor tile preferably through two surfaces. Similarly, the female locking device 1606 also extends along the length of the ceramic floor tile and is glued to the ceramic floor tile preferably through two surfaces. The male locking device 1604 and female locking device 1606 may also be made from other rigid yet flexible materials, such as foam or other similar materials. It can also use relative rigid and strong materials with a spring slot (not shown) in 1604; the materials can be wood, aluminum, steel, plastic, plastic wood composite, etc. The locking devices 1604, 1606 may also be attached to the ceramic floor tile through other attachment means, such as screw. FIG. 17 depicts two adjacent ceramic floor tiles engaging each other.

Figure 18:
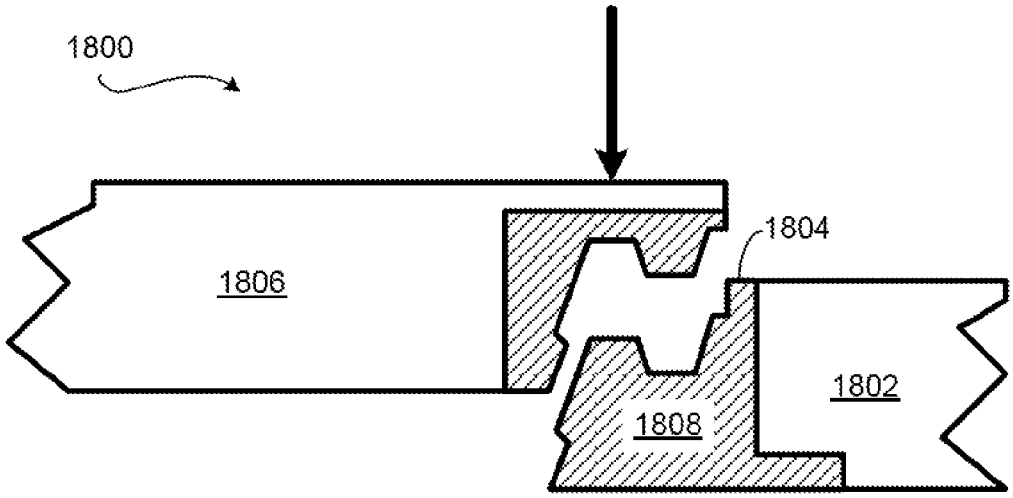
FIG. 18 depicts a variation of the embodiment shown in FIG. 16.

FIG. 18 illustrates the profile 1800 of another alternative embodiment of a ceramic floor tile. The male locking device 1808 is equipped with an isolation edge 1804 that prevents the edge of the ceramic floor tile 1806 touches and rubs against the edge of the adjacent ceramic floor board 1802. The isolation edge 1804 eases the installation of ceramic floor because it provides allowance to the imperfections that are often present in the ceramic floor tiles. The isolation edge 1804 also eliminates the need for grouting in traditional ceramic floor tiles. It could help to achieve water seal between ceramic tiles.

Figure 19:
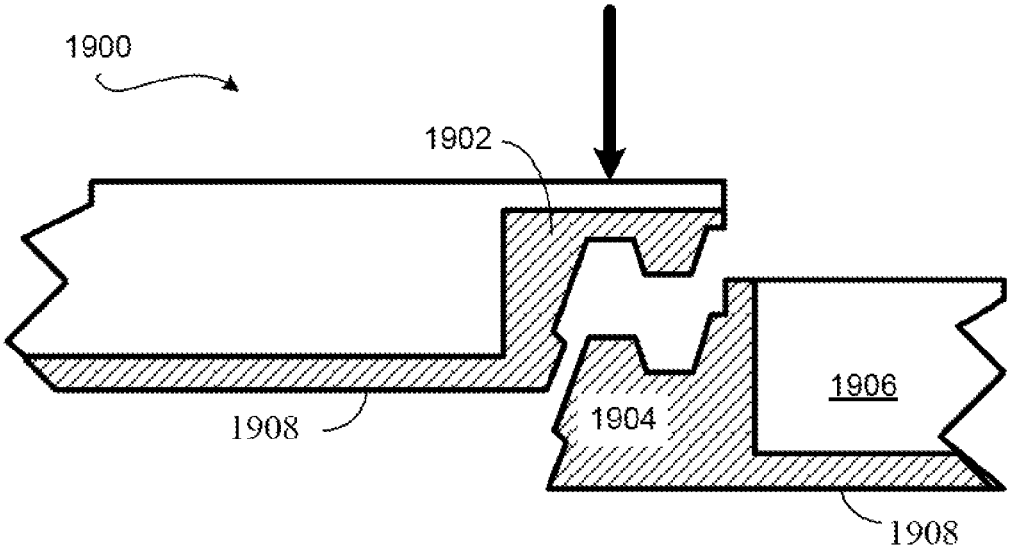
FIG. 19 depicts yet another alternative embodiment of the invention.

FIG. 19 depicts the profile 1900 of yet another alternative embodiment of the invention. The male locking device 1904 and female locking device 1902 are interconnected through a base layer 1908, which effectively encloses the entire ceramic floor tile 1906 from bottom and ail lateral sides. The ceramic floor tiles of FIG. 19 allows the ceramic floor be installed without using traditional cement that attaches the ceramic floor tiles to the underlayment layer. With ceramic floor tiles of FIG. 19, the ceramic floor can be installed easily by laying the ceramic floor tiles on the underlayment layer and the engaging one ceramic floor tile with its neighboring ceramic floor tile through the male and female locking devices. The combined female locking device 1902, male locking device 1904, and base layer 1908 may be made from steel or any suitable metallic material. The combination may also be made from plastic.

Figure 20:
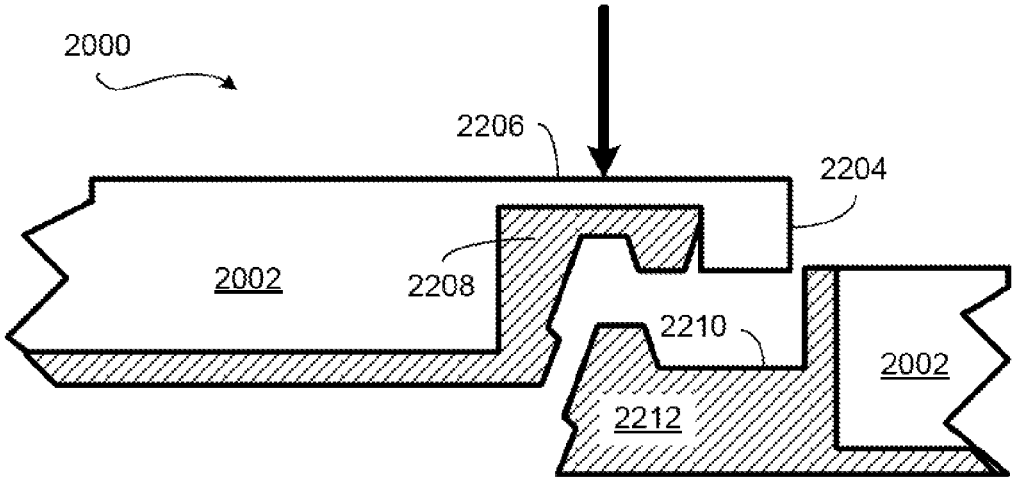
FIG. 20 depicts yet another alternative embodiment of the invention with a support column.

FIG. 20 illustrates the profile 2000 of yet another alternative embodiment of the invention. As to prevent any possible weakness in the ceramic floor tile because of thin surface layer 2206 needed for placement of the female locking device 2208, an extra support column 2204 is provided. After the two adjacent ceramic floor tiles are engaged and locked, the support column 2204 sits on the support surface 2210 of the male locking device 2212, thus providing additional support to the surface layer 2206 against the downward force.

Figure 21:
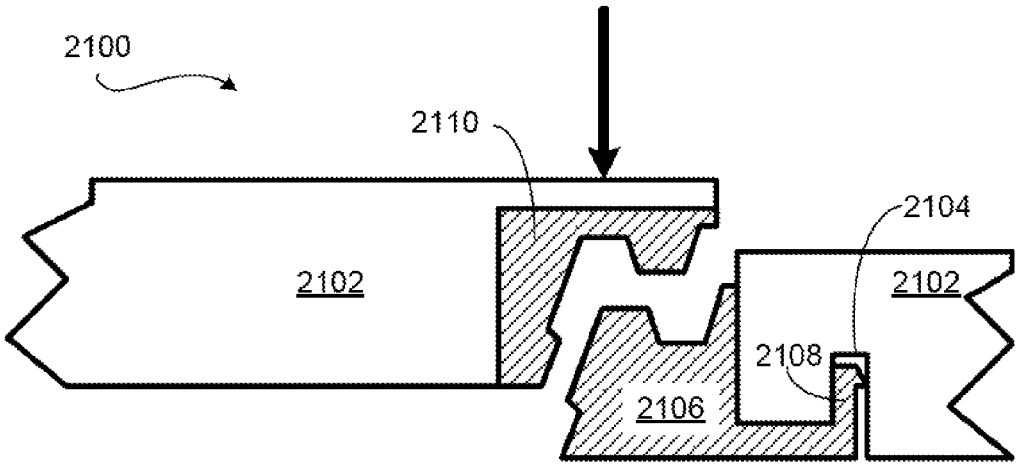
FIG. 21 depicts yet another alternative embodiment of the invention with short length locks.

For different kind of boards where water seal is not necessary, instead of having a male locking device of FIG. 21 glued to the entire length of the ceramic floor, the male locking device can be made into a short length lock 2106 and multiple short length locks can be replaced along the length of a ceramic floor tile. The short length lock 2106 can be attached to the ceramic floor tile through use of a locking hook 2108 that can be inserted into a locking slot 2104 on the ceramic floor tile 2102. Those skills in the art will appreciate that the roles of the male locking device 2106 and female locking device 2110 are interchangeable; instead of the short length lock being a male locking device, the short length lock may be a female locking device.

Figure 23:
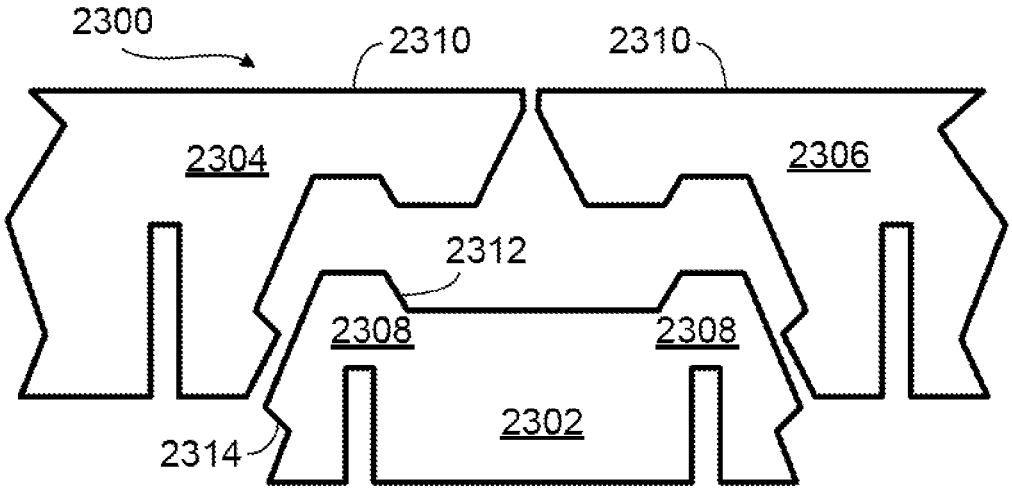
FIG. 23 depicts two floor boards being joined by a locking clip.
Figure 39:
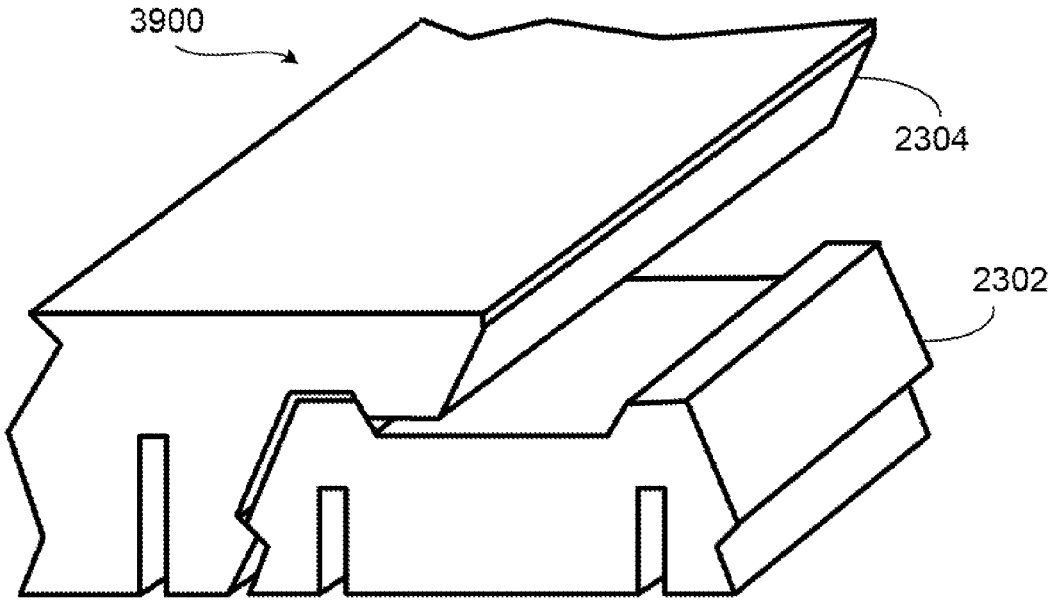
FIG. 39 depicts perspective view of a locking clip attached to one floor board.

FIG. 23 depicts a locking clip 2302 according to the invention. The locking clip 2302 is a discreet device that can be placed along the length of two adjacent floor boards 2304, 2306 joining them together. FIG. 39 is a perspective view of one locking clip 2302 attached to one floor board 2304. The locking clip 2302 includes two male locking devices 2308 joined together and sharing a common downwardly recessed region, where each male locking device will engage the female locking device 230 of each floor board. The locking clip 2302 is firmly attached to the floor board through the compression forces applied to the surfaces 2312 and 2314 by the female locking device 2310. The locking clip 2302 may be made from wood, metal, plastic, rubber, vinyl, fiber glass, and other suitable materials. The locking clip 2302 may be used to join not only floor boards, but also roof tiles, wall tiles, and siding panels.

Figure 24:
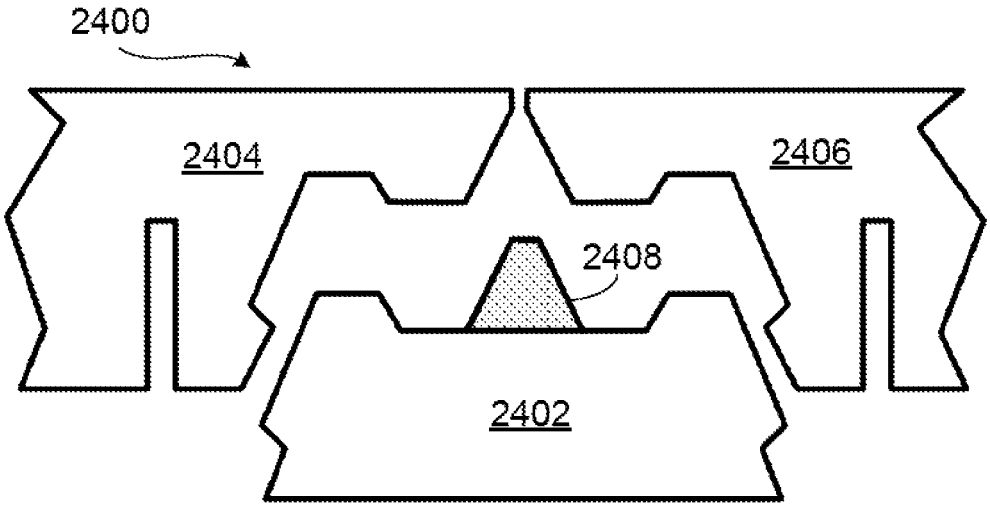
FIG. 24 depicts profile of an alternative embodiment of a locking clip with a sealer.

FIG. 24 illustrates an alternative embodiment of a locking clip 2402. The locking clip 2402 includes a protruding sealer 2408. The sealer 2408 can be made from rubber, foam, plastic, or other flexible material and has a length similar to the floor board's length. The sealer 2408 squeezes into the space between two adjacent floor boards 2404, 2406, thus preventing penetration of water from the gap between the adjacent floor boards. The sealer 2408 solves any problem that might be caused by manufacturing defects that a floor board may have.

Figure 25:
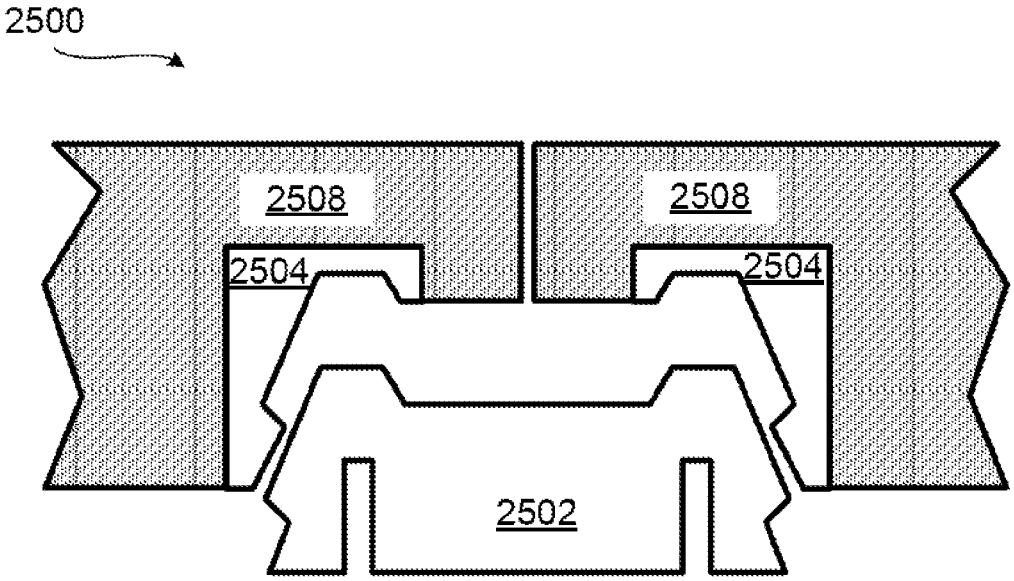
FIGS. 25-27 illustrates use of a locking clip to join different ceramic floor tiles.
Figure 26:
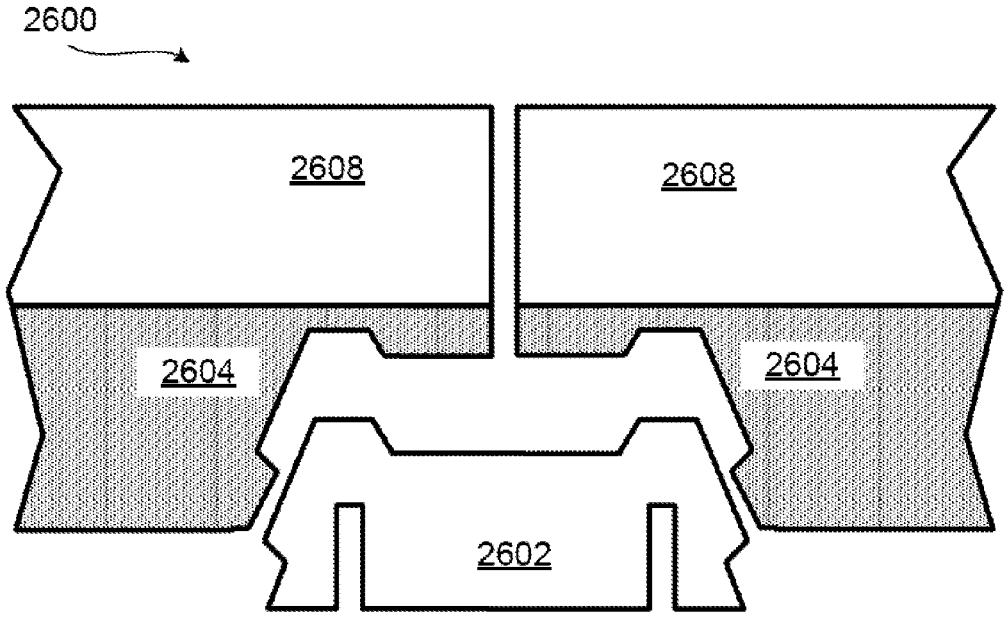
Figure 27:
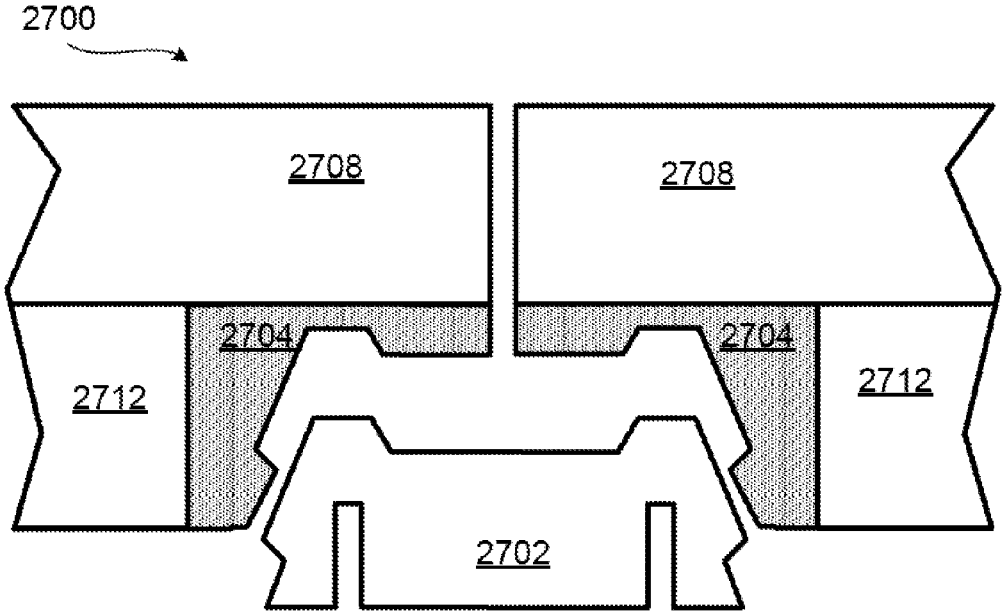
Figure 28:
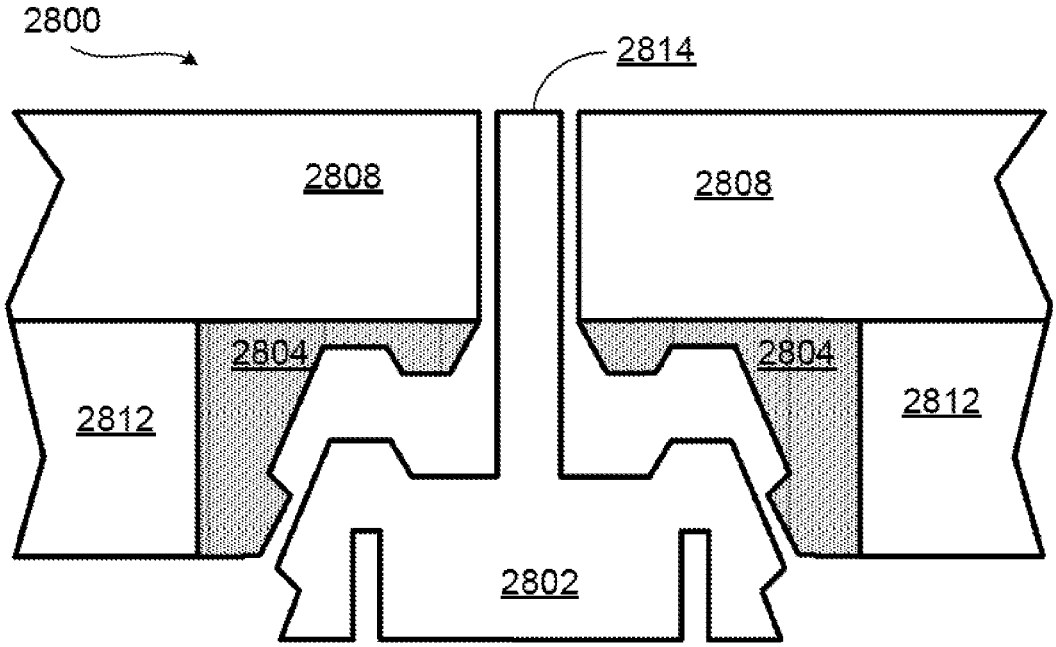
FIG. 28 illustrates profile of an alternative embodiment of a locking clip with an elongated sealer.

FIG. 25 depicts use of a locking clip 2502 with ceramic tiles. Similar to ceramic tiles depicted in FIGS. 16 and 17, a strip of female locking device 2504 may be attached a ceramic floor tile 2508, and two adjacent ceramic floor tiles may be joined by the locking clips 2502. Alternatively, the ceramic tile 2608 may be attached on the top of a substrate 2604 as shown in FIG. 26. The substrate 2604 may be made from rubber, wood, foam, plastic, or other suitable material. The substrate 2604 includes female locking device on its border and locking clips 2602 can be used to join adjacent ceramic floor tiles. The embodiment shown in FIG. 26 eliminates the need for special ceramic floor tiles. FIG. 27 shows yet another embodiment of a ceramic floor tile 2708. In the embodiment shown in FIG. 27, the ceramic floor tile 2708 can be attached to a substrate 2712 that is made from a man-made material, such as plastic, fiber glass, foam, cement board, etc. A strip of female locking device 2704 can be attached to the substrate 2712 and under the ceramic tile 2708. Again, locking clips 2702 may be used to join two adjacent ceramic tiles. FIG. 28 illustrates an embodiment of a locking clip 2802 that includes an elongated sealer 2814. The locking clip 2802 is preferably made from rubber or a rigid, yet flexible material and preferably runs the length of the female locking device attached to the ceramic tile 2808. The sealer 2814 provides a softer interface between the two joining ceramic tiles 2808 and also seals the gap between two adjacent ceramic tiles 2808.

Figure 29:
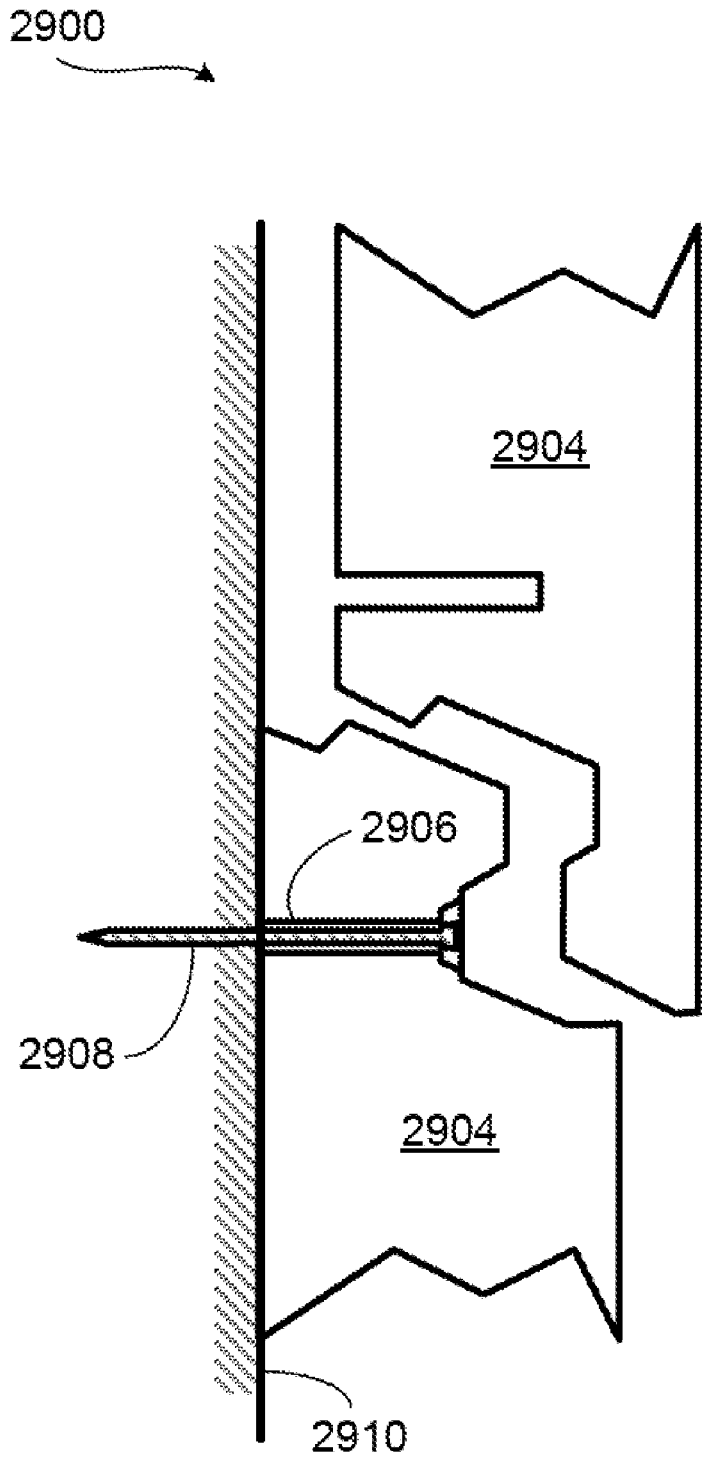
FIG. 29 illustrates attachment of floor boards onto a wall.

The floor boards and ceramic tiles according to the invention can be used not to cover the floor but also to cover walls or roofs. FIG. 29 illustrates an alternative embodiment of boards 2904 used to cover a rail 2910. The board 2904 has several holes 2906 distributed along the board's length and the holes are located at the downwardly recessed region of the male locking device. The board 2904 can be affixed to the wall 2910 through use of nails or screws 2908. After a board 2904 is attached to the wall, then an adjacent board can be placed and joined.

Figure 30:
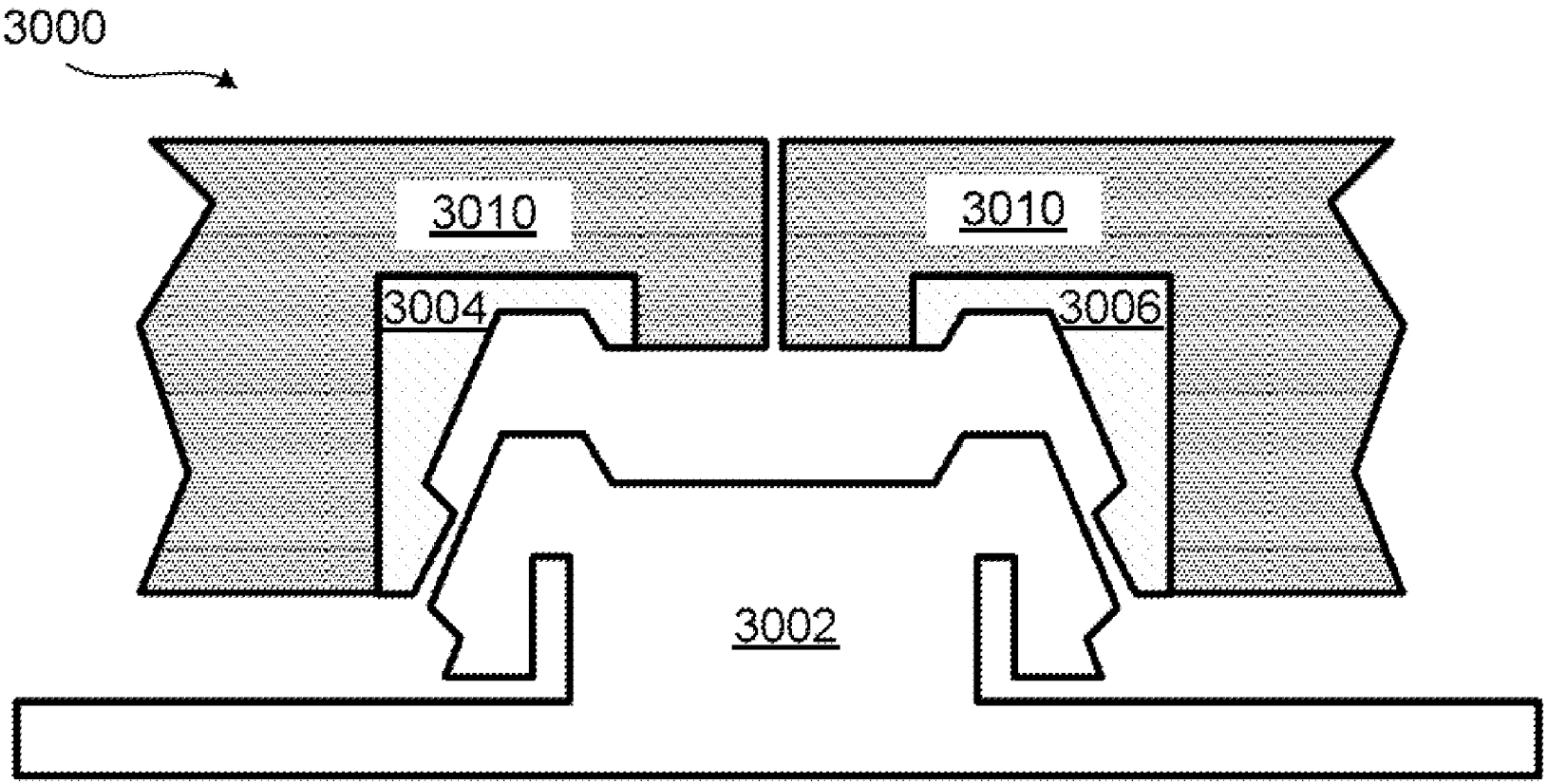
FIG. 30 illustrates attachment of floor tiles onto a wall.
Figure 31:
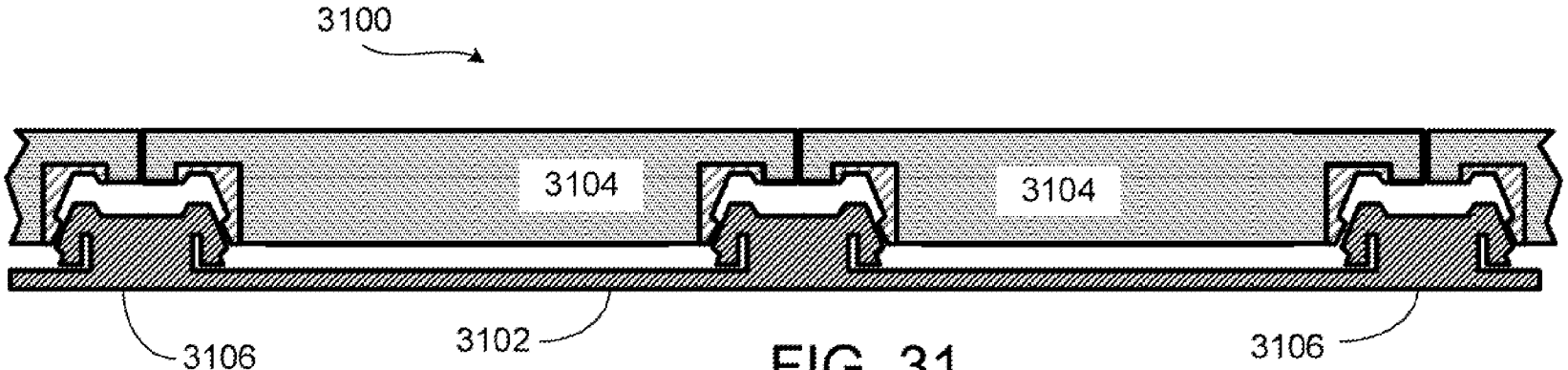
FIG. 31 illustrates attachment of multiple floor tiles onto a wall using an underlayer.
Figure 32:
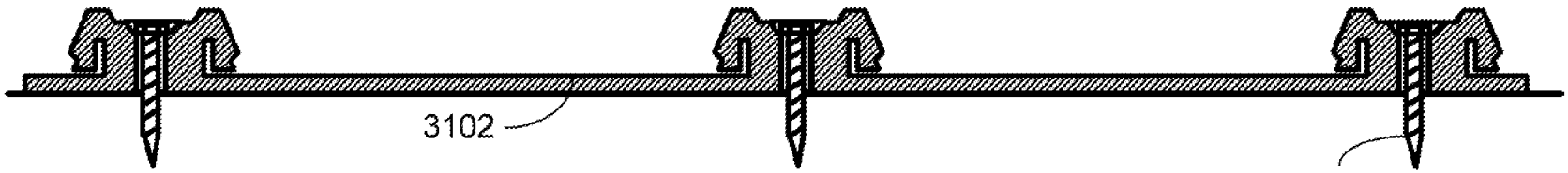
FIG. 32 illustrates attachment of an underlayer onto a wall.
Figure 40:
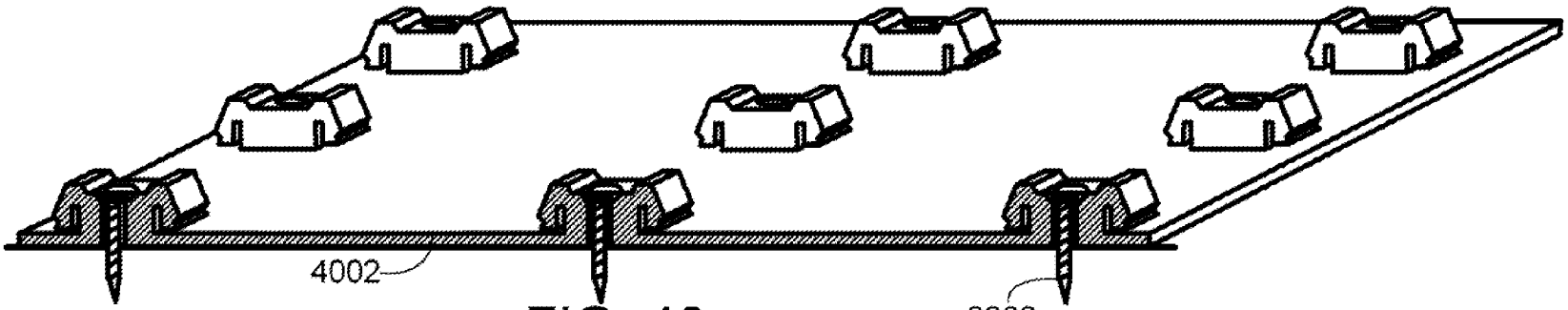
FIG. 40 depicts perspective view of an underlayer with a plurality of locking clips.

Wall tiles 3010 can also be used to cover the walls in a similar fashion as shown in FIG. 30. FIG. 31 illustrates profile of a underlayer 3102 where a plurality of locking clips 3106 are attached and ceramic (wall) tiles 3104 are placed on the underlayer 3102. The underlayer 3102 can be attached to the wall through nails or screws 3202 as shown in FIG. 32. Installation of a ceramic floor can be made easy with ceramic tiles and underlayer shown in this application. This application allows a damaged tile to be easily replaced by break it up and replace by a new one. FIG. 40 is an illustration of an underlayer 4002 and multiple locking clips are distributed on the underlayer 4002. The underlayer is preferably made from a soft and flexible material, such as rubber or foam. However, the underlayer may also be made from wood board, cement board, or fiber board. The locking clips are preferably made from a more rigid, yet flexible material, such as rubber, plastic, fiber glass, or metal. An installer can easily install ceramic tiles of the present invention on this underlayer 4002 by attaching the underlayer 4002 on the floor using the nails, and then placing the ceramic tiles on the top of the under layer 4002. Optionally, there are a plurality of nail holes on the underlayer and these nail holes are shown as being located on the locking clips. Alternatively, the nails can be placed anywhere on the underlayer. The ceramic tiles will be secured by the locking clips. This option offer the wall tile double water protection: one is from the lock seal and another is from the underlayment. A system using elements shown in FIGS. 30, 31, 32, and 40 can be applied to a variety of surfaces; the system can be used with not only wall tiles, but also with roof tiles, floor tiles, and siding tiles.

Figure 33:
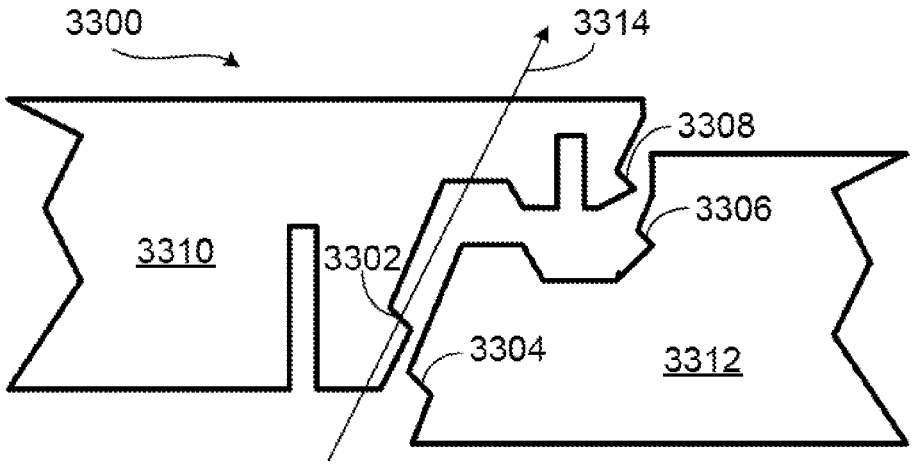
FIG. 33 illustrates engagement of two floor boards via two pairs of locking surfaces.
Figure 34:
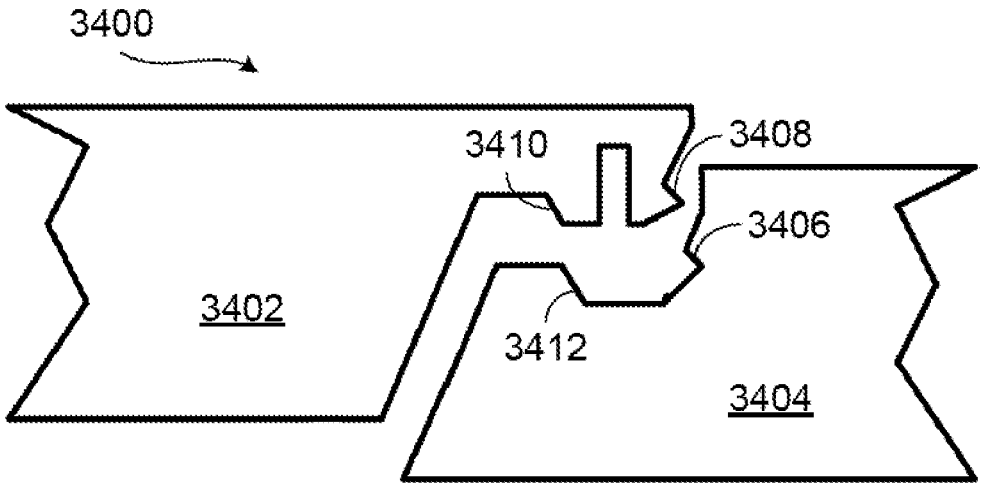
FIG. 34 illustrates engagement of two floor boards via one pair of locking surfaces.
Figure 35:
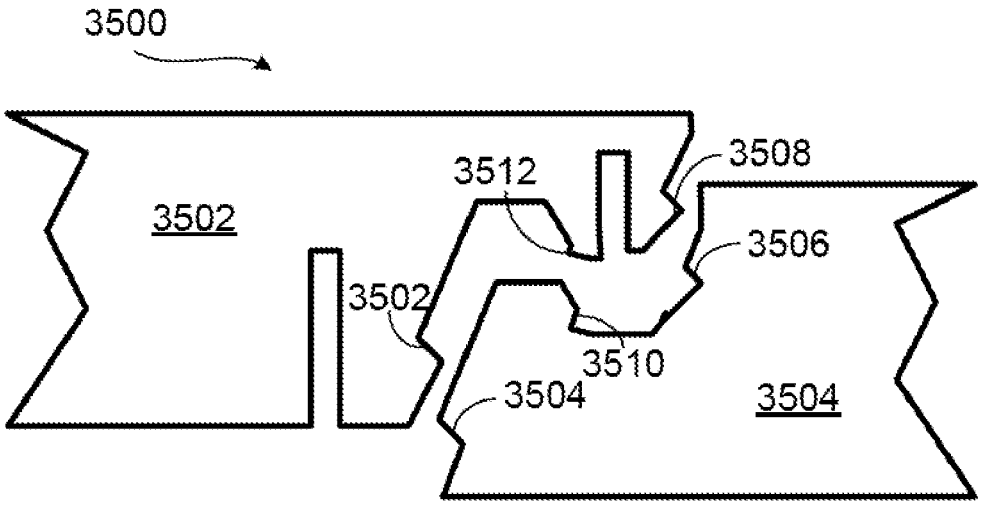
FIG. 35 illustrates engagement of two floor boards via three pairs of locking surfaces.

FIG. 33 depicts an alternative embodiment of the present invention where two adjacent floor boards are engaged by two pairs of locking surfaces 3306 and 3308, and 3302 and 3304. The locking surfaces 3308, 3306 have similar construction as locking surfaces 3302, 3304. If a perpendicular arrow line 3314 is drawn relative to the locking surface 3302, the line would point toward the floor board 3312. Therefore, the pair of locking surfaces 3302 and 3304 would be classified as pointing toward the male locking device. The pair of second locking surfaces 3306 and 3308 also points toward the male locking device. This double locking is useful for a board that requires extra locking force, such as roof tiles and wall tiles. When one lock fails, other lock is still in place. FIG. 34 illustrates another embodiment where two adjacent floor boards are secured with joining of locking surfaces 3406 and 3408. When two adjacent boards are engaged, they are secured by the compression forces acting on surfaces 3406, 3408 and on surfaces 3410, 3412. FIG. 35 illustrates yet another embodiment where two adjacent floor boards are secured by three pairs of locking surfaces: locking surfaces 3502 and 3504, locking surfaces 3506 and 3508, and locking surfaces 3510 and 3512. Two pairs of locking surfaces 3506-3508 and 3502-3504 point toward the male locking device but the third pair of locking surfaces 3510-3512 points toward the female locking device. Because the locking surfaces pairs pointing toward two opposite directions, it is virtually impossible to unlock two boards after they are engaged. This locking mechanism is useful for roof tile application where wind may blow from underneath. The lock may be disengaged by the wind, the three locks will make a dead lock and further secure the boards together.

Figure 36:
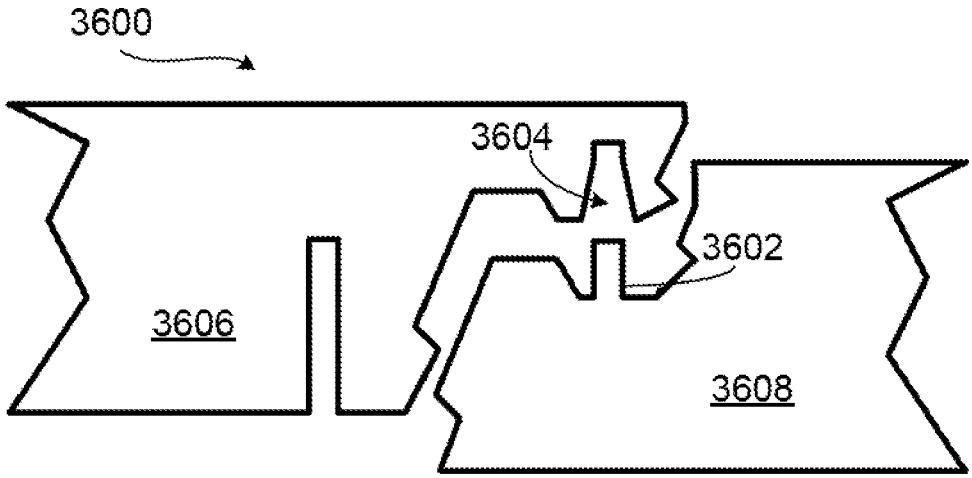
FIG. 36 illustrates engagement of two floor boards via two pairs of locking surfaces and use of one sealer.
Figure 37:
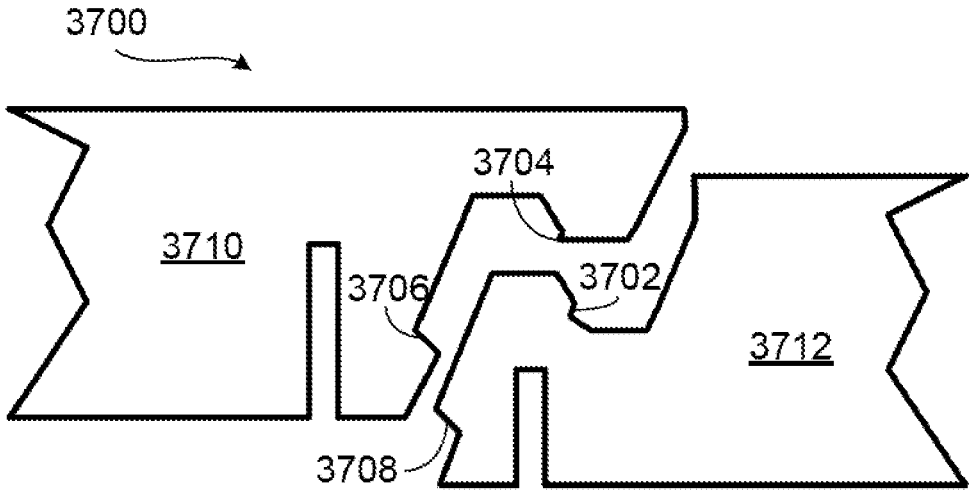
FIG. 37 illustrates another engagement of two floor boards via two pairs of locking surfaces.
Figure 38:
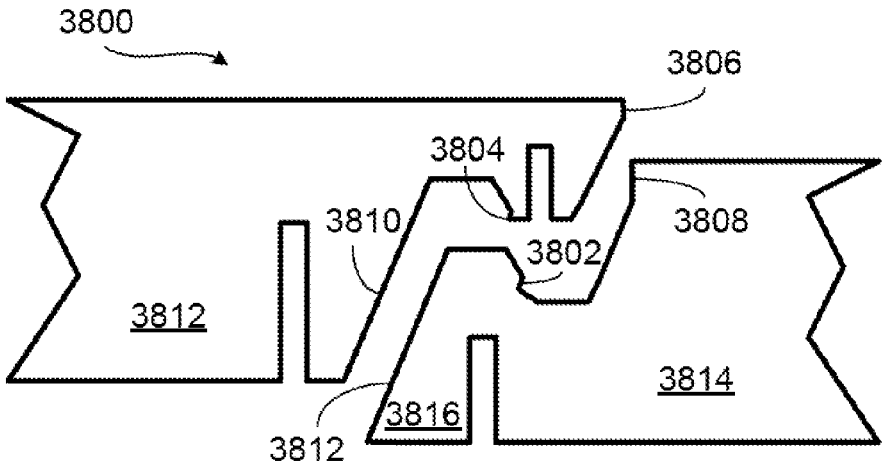
FIG. 38 illustrates another engagement of two floor boards via one pair of locking surfaces.

FIG. 36 depicts an embodiment where the male locking device is equipped with a sealer 3602 located at the downwardly recessed region and the female locking device is equipped with a recess 3604 located at downwardly protruding region. The sealer 3602 will add to the strength of the entire locking mechanism and making it virtually impossible to separate two adjacent floor boards. FIG. 37 depicts an embodiment where two adjacent floor boards are secured by two pair of locking surfaces. FIG. 38 illustrates a simple, but efficient way to secure two adjacent floor boards. Two adjacent floor boards are secured by one pair of locking surfaces 3802, 3804. Though there is only one pair of locking surfaces 3802-3804, they point toward the female locking device, thus making it almost impossible to disengage two boards if one tries to disengage them by lifting the floor board 3812. Two boards 3812 and 3814 will not disengage by lifting floor board 3814 because of the base 3816 of the male locking device being extended beyond the pair of locking surfaces 3802-3804. This construction also makes it virtually impossible to separate two adjacent floor boards.

Figure 41:
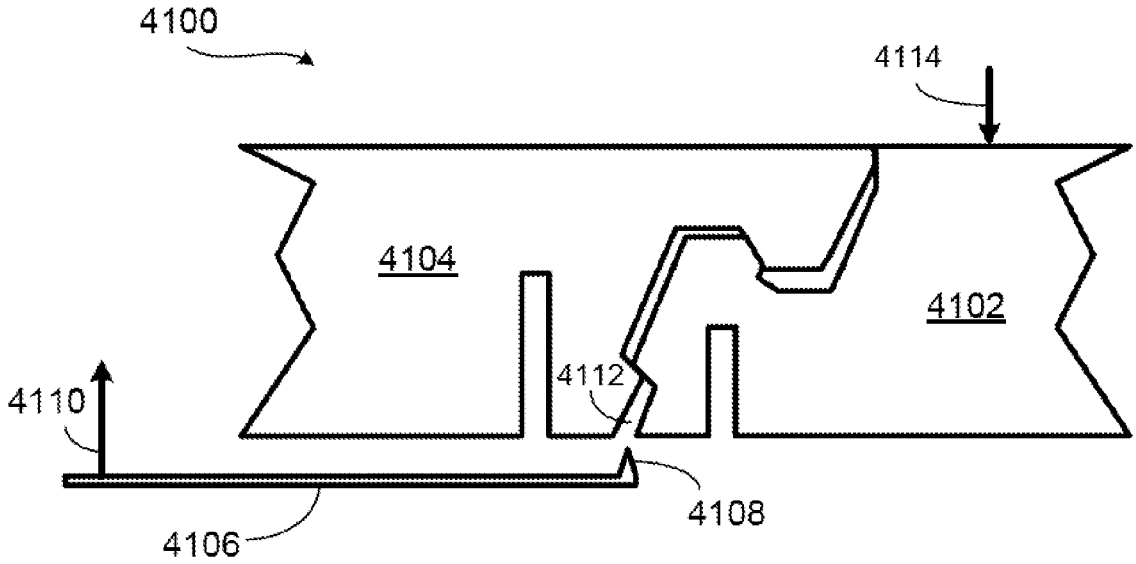
FIG. 41 illustrates a device used for separating two engaged boards.

FIG. 41 illustrates a key that can be used to separate two engaged boards. The key has preferably a flat body 4106 with a raised tip 4108 that can be slid under the boards. The raised tip 4108 can be slid into the gap 4112 between two adjacent boards 4102, 4104. By lifting 4110 the key and consequently the floor board 4104 and applying a downward force 4114 on the floor board 4102, two boards can be easily separated.

Though the invention is described above using hardwood floor boards as examples, the invention can be easily applied to other uses, such as wall panels, wall tiles, external sidings, roof panels, ceiling panels, solar cell panels, ceiling tiles, and TV panels. The press down locking mechanism can be used with boards, panels, and tiles of different materials, such as, wood, particle boards, laminate material, plastic, cement, metal, fiber glass, porcelain, ceramic, etc.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents. Dimensions in the drawings here presented are not to the scale unless otherwise indicated.

What is claimed is:

1. A floor board comprising:
- a top side;
- a bottom side;
- a front end;
- a back end;
- a left end, the left end having a male locking device; and
- a right end, the right end having a female locking device and a spring slot defining the female locking device,
- wherein the male locking device comprises
  - a downwardly recessed region open to the top side,
  - a upwardly protruding, region adjacent to the recessed region, and
  - a locking corner defining one side of the protruding region,
- wherein the female locking device comprises
  - a downwardly protruding region,
  - a upwardly recessed region open to the bottom side and adjacent to the downwardly protruding region,
  - a locking edge defining one side of the downwardly recessed region, and
  - a locking column defined by the spring slot and the locking edge.

2. The floor board of claim 1, wherein the front end further comprising a male locking device, the back end further comprising a female locking device, the male locking device comprises
- a downwardly recessed region,
- a upwardly protruding region adjacent to the recessed region, and
- a locking corner defining one side of the protruding region,
- the female locking device comprises
- a downwardly protruding region,
- a upwardly recessed region adjacent to the downwardly protruding region, and
- a locking edge defining one side of the upwardly recessed region.

3. The floor board of claim 1, wherein the floor board having a length and the male locking device and the female locking device being along the length.

4. The floor board of claim 1, further comprising a thin film covering the male locking device.

5. The floor board of claim 1, further comprising a thin film covering the female locking device.

6. The floor board of claim 1, wherein the male locking device further comprising a male interface element and the female device further comprising a female interface element.

7. The floor board of claim 6, wherein both the male interface element and the female interface element being made from plastic.

8. The floor board of claim 6, wherein both the male interface element and the female interface element being made from rubber.

9. The floor board of claim 6, wherein both the male interface element and the female interface element being made from metal.

10. The floor board of claim 6, wherein both the male interface element and the female interface element being made from a different type of wood.

11. The floor board of claim 1, further comprising a second spring slot defining the male locking device.

12. The floor board of claim 1, further comprising at least one hole located in the downwardly recessed region.

13. A floor system comprising:

a first floor board having a male locking device; and a second floor board having a female locking device and a spring slot defining the female locking device wherein the female locking device comprises a downwardly protruding region, a upwardly recessed region open to the bottom side and adjacent to the downwardly protruding region, a locking edge defining one side of the downwardly recessed region, and a locking column defined by the spring slot and the locking edge, wherein the female locking device of the second board being engaged to the male locking device of the first board by pressing down the female locking device of the second board against the male locking device of the first board, and the spring slot on the second floor board provides a spring effect to the female locking device.

14. The floor system of claim 13, wherein the male locking device further comprising:

a downwardly recessed region;

a upwardly protruding region adjacent to the recessed region; and a locking corner defining one side of the protruding region.

15. The floor system of claim 13, wherein the female locking device further comprising:

a downwardly protruding region;

a upwardly recessed region adjacent to the downwardly protruding region; and a locking edge defining one side of the upwardly recessed region.

16. A floor system comprising:

a first floor board having a male locking device; and a second floor board having a female locking device defined by a spring slot wherein the female locking device comprises a downwardly protruding region, a upwardly recessed region open to the bottom side and adjacent to the downwardly protruding region, a locking edge defining one side of the downwardly recessed region, and a locking column defined by the spring slot and the locking edge, wherein the male locking device of the first floor board being engaged to the female locking device through application of a vertical force on the second floor board, wherein the male locking device engages the female locking device on no more than three separate and independent contact surfaces.

17. The floor system of claim 16, wherein the male locking device being made from a different material than the floor board.

18. The floor system of claim 16, wherein the first floor board further comprising a spring slot that defines the male locking device.

19. A floor system comprising:

a first floor board having a female locking device, the female locking device, being defined by a substantially straight spring slot; and wherein the female locking device comprises a downwardly protruding region, a upwardly recessed region open to the bottom side and adjacent to the downwardly protruding region, a locking edge defining one side of the downwardly recessed region, and a locking column defined by the spring slot and the locking edge a second floor board having a male locking device, wherein the first floor board and the second floor board being engaged by a predetermined pairs of locking surfaces.

20. The floor system of claim 19, wherein the number of pairs of locking surfaces being one.

21. The floor system of claim 19, wherein the one pair of locking surfaces located in the downwardly protruding region.

22. The floor system of claim 19, wherein the number of pairs of locking surfaces being two.

23. The floor system of claim 22, wherein the two pairs of locking surfaces located in the downwardly protruding region.

24. The floor system of claim 19, wherein the number of pairs of locking surfaces being three.

25. The floor system of claim 19, wherein the number of pairs of locking surfaces being one and the pair of locking surfaces point toward the female locking device.

26. The floor system of claim 19, wherein the number of pairs of locking surfaces being two and two pairs locking surfaces points toward opposite directions.

* * * * *